US011529715B2

(12) United States Patent
Adia et al.

(10) Patent No.: US 11,529,715 B2
(45) Date of Patent: Dec. 20, 2022

(54) SUPERHARD STRUCTURE OR BODY COMPRISING A BODY OF POLYCRYSTALLINE DIAMOND CONTAINING MATERIAL

(71) Applicant: Element Six Abrasives S.A., Luxembourg (LU)

(72) Inventors: Moosa Mahomed Adia, Springs (ZA); Geoffrey John Davies, Springs (ZA)

(73) Assignee: ELEMENT SIX ABRASIVES S.A., Luxembourg (LU)

( * ) Notice: Subject to any disclaimer, the term of this patent is extended or adjusted under 35 U.S.C. 154(b) by 825 days.

(21) Appl. No.: 16/356,126

(22) Filed: Mar. 18, 2019

(65) Prior Publication Data

US 2020/0047312 A1 Feb. 13, 2020

Related U.S. Application Data

(63) Continuation of application No. 15/192,110, filed on Jun. 24, 2016, now abandoned, which is a (Continued)

(30) Foreign Application Priority Data

Dec. 21, 2011 (GB) ..... 1122064

(51) Int. Cl.
*B24D 3/10* (2006.01)
*C22C 26/00* (2006.01)

(52) U.S. Cl.
CPC ..... *B24D 3/10* (2013.01); *C22C 26/00* (2013.01)

(58) Field of Classification Search
CPC ..... B24D 3/10; C22C 26/00
See application file for complete search history.

(56) References Cited

U.S. PATENT DOCUMENTS 9,484,096 B1 11/2016 Chen et al.
2010/0095602 A1 4/2010 Belnap et al.
(Continued)

FOREIGN PATENT DOCUMENTS

GB 2408735 8/2005
GB 2450221 12/2008
(Continued)

OTHER PUBLICATIONS

Franz, Low Expansion Alloys, Metal Handbook, 10th Ed., vol. 2, p. 889-896 1990.

(Continued)

*Primary Examiner* — Alexandra M Moore
(74) *Attorney, Agent, or Firm* — Bryan Cave Leighton Paisner LLP

(57) ABSTRACT

A free standing PCD body comprises a PCD material formed of combination of intergrown diamond grains forming a diamond network and an interpenetrating metallic network, the PCD body not being attached to a second body or substrate formed of a different material. The diamond network is formed of diamond grains having a plurality of grain sizes, and comprises a grain size distribution having an average diamond grain size, wherein the largest component of the diamond grain size distribution is no greater than three times the average diamond grain size. The PCD material forming the free standing PCD body is homogeneous, such that the PCD body is spatially constant and invariant with respect to diamond network to metallic network volume ratio. The homogeneity is measured at a scale greater than ten times the average grain size and spans the dimension of the PCD body. The PCD material is also macroscopically residual stress free at said scale.

23 Claims, 12 Drawing Sheets

Related U.S. Application Data continuation of application No. 14/367,157, filed as application No. PCT/EP2012/076430 on Dec. 20, 2012, now abandoned.

(60) Provisional application No. 61/578,726, filed on Dec. 21, 2011.

(56) References Cited

U.S. PATENT DOCUMENTS

| | | | | |
|---|---|---|---|---|
| 2010/0300764 | A1* | 12/2010 | Naidoo | E21B 10/46 51/296 |
| 2011/0036643 | A1 | 2/2011 | Belnap et al. | |
| 2011/0083907 | A1 | 4/2011 | Israelsson et al. | |
| 2011/0262295 | A1 | 10/2011 | Voronov et al. | |

FOREIGN PATENT DOCUMENTS

| | | |
|---|---|---|
| JP | S63262432 | 10/1988 |
| JP | H03150303 | 6/1991 |
| WO | 2010092537 | 8/2010 |
| WO | 2010092540 | 8/2010 |

OTHER PUBLICATIONS

Dollimore, The termal decomposition of oxalates: a review. Thermochimica Acta, 117: 331-363 1987.

Ehrhardt et al., Thermal decomposition of cobalt nitrate compounds: Preparation of anhydrous cobalt (II) nitrate and its characterization by infrared and raman spectra, Thermochicmica Acta, 432:26-40 2005.

Sung, A century of progress in the development of very high pressure apparatus for scientific research and diamond synthesis, High Temperatures—High Pressures, 29: 253-293 1997.

Brockner et al., Thermal decomposition of nickel nitrate hexahydrate, NI (NO3)2—4H2O, Thermochimica Acta, 456: 64-68 2007.

Patent Cooperation Treaty, International Search Report for PCT/EP2012/076430 dated May 3, 2013.

United Kingdom Intellectual Property Office, Search Report for GB1122064.7 dated May 17, 2012.

United Kingdom Intellectual Property Office, Search Report for GB1223013.2 dated Sep. 11, 2013.

Patent Cooperation Treaty, International Search Report for PCT/EP2012/076450 dated May 3, 2013.

United Kingdom Intellectual Property Office, Search Report for GB1122066.2 dated May 24, 2012.

United Kingdom Intellectual Property Office, Search Report for GB1223033.0 dated Sep. 11, 2013.

* cited by examiner

SUPERHARD STRUCTURE OR BODY COMPRISING A BODY OF POLYCRYSTALLINE DIAMOND CONTAINING MATERIAL

FIELD

This disclosure relates to a superhard structure or body comprising a body of polycrystalline diamond containing material, a method of making such a body, and to elements or constructions comprising polycrystalline superhard structures.

BACKGROUND

Polycrystalline diamond materials (PCD) as considered in this disclosure consist of an intergrown network of diamond grains with an interpenetrating metallic network. This is illustrated schematically in FIG. 1 which shows the microstructure of PCD material comprising the intergrown network of diamond grains 1 with an inter-penetrating metallic network 2 with facets occurring at the diamond-metal interfaces 3. Each grain has a degree of plastic deformation 4. Newly crystallized diamond bonds 5 bond the diamond grains as shown in the inset of this figure. The network of diamond grains is formed by sintering of diamond powders facilitated by molten metal catalyst/solvent for carbon at elevated pressures and temperatures. The diamond powders may have a monomodal size distribution whereby there is a single maximum in the particle number or mass size distribution, which leads to a monomodal grain size distribution in the diamond network. Alternatively, the diamond powders may have a multimodal size distribution where there are two or more maxima in the particle number or mass size distribution, which leads to a multimodal grain size distribution in the diamond network. Typical pressures used in this process are in the range of around 4 to 7 GPa but higher pressures up to 10 GPa or more are also practically accessible and can be used. The temperatures employed are above the melting point at such pressures of the metals. The metallic network is the result of the molten metal freezing on return to normal room conditions and will inevitably be a high carbon content alloy. In principle, any molten metal solvent for carbon which can enable diamond crystallization at such conditions may be employed. The transition metals of the periodic table and their alloys may be included in such metals.

Conventionally, the predominant custom and practice in the prior art is to use the binder metal of hard metal substrates caused to infiltrate into a mass of diamond powder, after melting of such binders at the elevated temperature and pressure. This is infiltration of molten metal at the macroscopic scale of the conventional PCD construction, i.e., infiltrating at the scale of millimeters. By far the most common situation in the prior art is the use of tungsten carbide, with cobalt metal binders as the hard metal substrate. This inevitably results in the hard metal substrate being bonded in-situ to the resultant PCD. Successful commercial exploitation of PCD materials to date has been very heavily dominated by such custom and practice.

For the purposes of this disclosure, PCD constructs which use hard metal substrates as a source of the molten metal sintering agent via directional infiltration and the bonding in-situ to that substrate, are referred to as "conventional PCD" constructions or bodies. This is illustrated in FIG. 2 which is a schematic diagram of the infiltration process in a conventional PCD body with arrows indicating the direction and the long range of the infiltration through 2 to 3 mm of thickness of the PCD layer. The arrows in the inset 11 indicate again that the range of infiltration transcends many diamond grains. The PCD layer 6 in a conventional PCD body is normally of the order of 2 to 3 mm in thickness. The substrate 7 is predominantly made of tungsten carbide/cobalt alloy. The number 8 indicates approximately the direction of the infiltration of the cobalt infiltrant through the thickness of the PCD layer during the high pressure high temperature process. The oval region 11 is at the interface between the carbide substrate and the PCD layer, and the inset of FIG. 2 shows schematically an expanded view of region 11 with the diamond grains in this region through which the long range infiltration of cobalt occurs. The inset highlights the fact that the directional infiltration transcends many grains through the thickness of the PCD layer. The diamond grains 9 and 10 may typically be of varying size in the body and could be made of multi modal mixes of diamond particles.

It has been appreciated that this conventional approach to the manufacture of PCD bodies results in a series of limitations and constraints which in turn have undesirable consequences in many applications. These limitations include:

1. Macroscopic residual stress distributions (at the scale of the conventional PCD body i.e. at the scale of millimeters) in the PCD body which inevitably have deleterious tensile components.
2. A dimensional limitation of PCD material layers in the direction of the infiltration of the molten metal from the substrate.
3. Structural and compositional in-homogeneities as a result of directional molten metal infiltration over a distance of the order of millimeters.
4. Significant practical difficulties in exploiting a broad range of metal alloy compositions and limited metallurgical compositions which result there from.
5. Micro residual stress management at the scale of the diamond micro structural grain size is limited and impractical.
6. Manufacturing degrees of freedom such as grain size distribution, metal content and metal alloy composition are co-dependent and cannot readily be independently preselected, chosen or varied.

The present applicants have appreciated that the limitations and problems with respect to homogeneity, macroscopic and microscopic residual stresses, size and shape of the PCD body, and restricted choice of material composition described above for conventional PCD bodies or constructions give rise to poor or inadequate performance in many applications.

There is a need for the development PCD bodies of any 3-dimensional shape, with high material homogeneity and with the absence of macroscopic residual stress, and with an expanded choice of PCD material structure and composition, with attendant micro residual stress control, all of which are highly desirable.

SUMMARY

Viewed from a first aspect there is provided a free standing PCD body comprising a PCD material formed of combination of intergrown diamond grains forming a diamond network and an interpenetrating metallic network, the PCD body not being attached to a second body or substrate formed of a different material, wherein:

a) the diamond network is formed of diamond grains having a plurality of grain sizes, the diamond network comprising a grain size distribution having an average diamond grain size, wherein the largest component of the diamond grain size distribution is no greater than three times the average diamond grain size; and b) the PCD material forming the free standing PCD body is homogeneous, the PCD body being spatially constant and invariant with respect to diamond network to metallic network volume ratio, wherein the homogeneity is measured at a scale greater than ten times the average grain size and spans the dimension of the PCD body, the PCD material being macroscopically residual stress free at said scale.

BRIEF DESCRIPTION OF THE FIGURES

Embodiments will now be described by way of example and with reference to the accompanying drawings in which.

DETAILED DESCRIPTION

Figure 1:
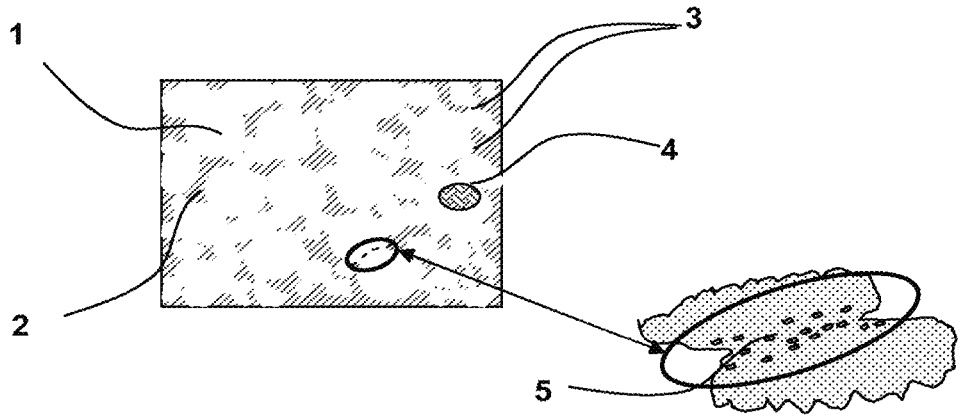
FIG. 1 is schematic diagram of the microstructure of PCD material showing the intergrown network of diamond grains with an inter-penetrating metallic network with facets occurring at the diamond-metal interfaces.
Figure 2:
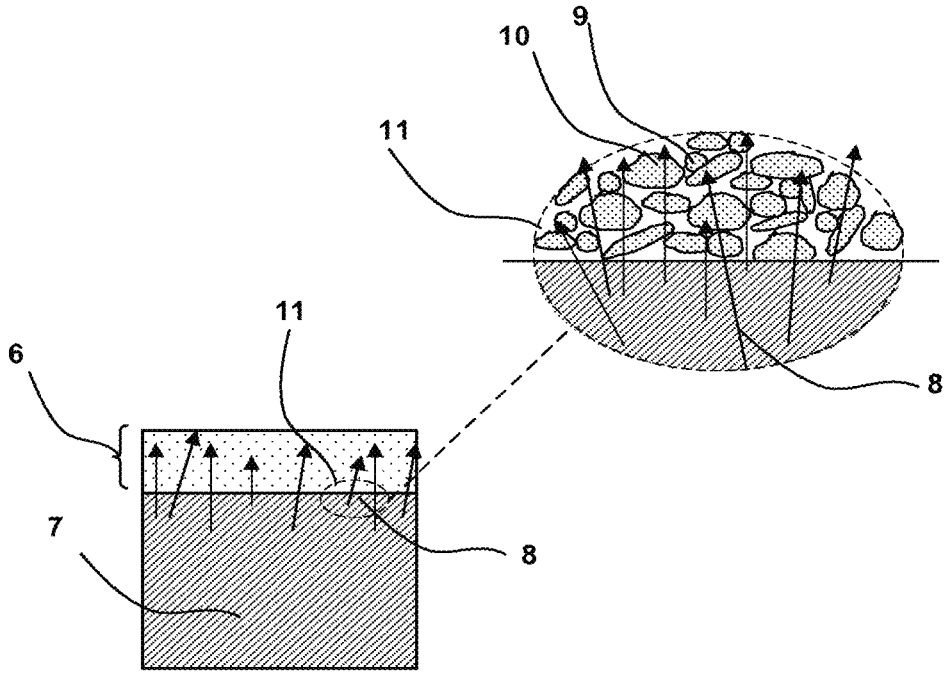
FIG. 2 is a schematic diagram of the infiltration process in a conventional PCD body with arrows indicating the direction and the long range of the infiltration through 2 to 3 mm of thickness of the PCD layer.

Prior art methods for making PCD materials are dominated by the use of substrates of metallic materials which provide a source of molten metal solvents for carbon which are caused to infiltrate a mass of diamond particles and via partial diamond recrystallisation result in diamond particle to particle intergrowth or sintering. Inevitably, such substrates are bonded to the resultant PCD material during such manufacturing procedure. There are many structural compositional and dimensional limitations and restrictions to the PCD material which follow from the use of such substrates. These include unavoidable macro residual stress distributions, PCD material layer thicknesses restricted practically to about 3 mm or less and limitations in both diamond to metal ratio and the elemental and alloy composition of the metal. The limitations of these prior art constructions which have been appreciated by the present applicants are set out below.

1. The residual stress is a distribution of tensile and compressive stresses in the body of the PCD material. At the scale related to the diamond grain size, which generally may be considered to be at the scale of less than ten times the average diamond grains size, where the coarsest component of grain size is no greater than three times the average diamond grain size, the stresses operative may be defined as and referred to as the "micro residual stress". At the scale greater than ten times the average diamond grain size, where the coarsest component of diamond grain size is less than three times the average diamond grain size, the stresses operative may be defined as and referred to as the "macro residual stress". Typically, for very fine PCD grain sizes this is at a scale greater than a few tens of micro meters. For coarse grain sized PCD materials, this scale may typically be greater than a tenth of a millimeter.

In the case of conventional PCD constructions the bonding of the substrate to the PCD layer invariably results in a macro residual stress distribution. This is as a result of the thermo elastic mismatch between the materials of the PCD layer and the substrate which, as a result of differential thermal contraction and elastic expansion, causes the residual stress distribution to form, on return to room temperature and pressure at the end of the sintering process. In the general case of metallic substrates, although the overall average macroscopic stress in the PCD layer is compressive, the residual stress distribution unavoidably, always has significant tensile stress components due to bending effects of the bonded PCD body. These tensile stress components promote crack propagation leading to early fracture of the PCD body during general mechanical applications. Early fracture signals the end of life of such a body. In certain instances, for example when very dissimilar materials are used for the PCD and the substrate, which can cause very high residual tensile stresses, fracture may even result from the manufacturing process alone. This is a contributor to a high product reject rate even in standard production processes.

Conventional PCD cutters used in rock drilling applications comprising a PCD element bonded to a hard metal substrate element particularly suffer from early fracture problems caused by crack propagation assisted by the macroscopic residual stresses. Much of the prior art for such cutters involves disclosures and inventions aimed at limiting such problems. Aspects such as non-planar interfaces between the PCD layer and carbide substrate, break-in chamfers at the PCD cutter leading edge, partial removal of the metal in the PCD by leaching at the surface, vacuum heat treatment annealing and, more recently, functional grading of the PCD layer and the carbide substrate have been developed and exploited to reduce the magnitude of the tensile component and/or displace these tensile maxima to positions remote from the free surfaces, and in so doing favorably alter the crack behavior of cutters. These prior art approaches have had some effect but do not provide a comprehensive solution to early fracture problems of this nature because the tensile components in the macroscopic residual stress distributions cannot be eliminated.

2. In principle, with the conventional approach, one could form a PCD layer on any size and shape of the substrate. The thickness of such a PCD layer in the direction of the infiltration is limited in practice by any one or combination of three possibilities. Firstly, above a thickness of about 3 mm the tensile component of the residual stress can become very significant and can be dominant in regard to failure of the PCD in manufacture or mechanically based applications. Secondly, a practical limitation in the range of molten metal infiltration results in insufficient metal for good diamond sintering to occur beyond a certain thickness of PCD, after which the desired properties of the material are lost. The infiltration range depends upon the diamond particle size distribution which determines the pore size distribution. A limited range in thickness to a few millimeters before inadequate metal for good diamond sintering is particularly the case for PCD wholly made from or with a fine grain component of less than 10 micron particles. Thirdly, directional infiltration of molten metal sweeps impurities such as oxygen and its compounds with the melt front. These impurities concentrate sufficiently at a particular range of thickness where they can interfere with the diamond sintering mechanisms leading to very poor quality PCD which now will have inferior properties.

The second and third factors contribute to inhomogeneity in both structure and composition of the PCD material. A consequence of limiting the thickness of the PCD material construction to a small number of millimeters is that large equi-axed three dimensional shapes for the PCD material component greater than this small dimension cannot be made. Thus, the PCD material component of a three dimensional construction is limited to a thin layer on the three dimensional substrate shape, no matter its size or shape. This thickness limitation is only minimally increased in the prior art by such means as metal powder additions to the starting diamond powder source layer. This inherently, of its very nature, limits the PCD material to high metal contents and thus can progressively compromise the structure and properties, and the homogeneity of such structures.

3. Structural and compositional in-homogeneities as a result of directional molten metal infiltration, occur discontinuously extending from the substrate which acts as the source of the molten metal diamond sintering aid into the PCD layer. In the most common case in which commercially available standard tungsten carbide cobalt hard metals are used as the substrate, immediately above the substrate a layer of up to a few tens of micro meters thick always occurs where nearly all of the diamond has been taken into solution by the molten cobalt allowing it to become saturated in dissolved carbon. This layer will then have low diamond content with little or no intergrowth between the remaining diamond grains. Above this layer, the molten cobalt saturated in dissolved carbon can now facilitate dissolution and re-precipitation of some of the diamond, which provides the diamond to diamond bonding. Where tungsten carbide cobalt hard metal substrates are used, the infiltrating molten cobalt often carries with it tungsten in solution. The tungsten, when it experiences the carbon now rapidly coming into solution, reacts with this carbon and solid tungsten carbide crystals precipitate. The tungsten carbide precipitation being governed by the normal rules of nucleation and growth of a solid phase in a liquid medium, results in tungsten carbide precipitates being distributed inhomogeneously in the metallic network of the PCD. Often, the tungsten carbide based inhomogeneity can be extreme with regions in the PCD volume containing areas of many tens of micro meters across, which are depleted in diamond and have a dominant population of tungsten carbide precipitates. Such inhomogeneity severely compromises the properties of PCD material where they occur, resulting in inferior performance in application.

Local inhomogeneity in diamond/metal content also arises due to the directional infiltration being unequal and/or not simultaneous across the expanse of the boundary area between the PCD and the substrate. This results in uncontrolled structural/compositional variations spatially, which cause local variations in PCD properties and, as such, can be considered as unwanted defects.

The in-homogeneity described in this section gives rise to residual stresses at the defined macroscopic scale of the PCD body by virtue of the thermo elastic property differences between the adjacent inhomogeneous parts of the material.

4. Molten metal infiltration from a substrate to form PCD is limited to the metal component of said substrate which is molten under appropriate pressure and temperature conditions for diamond recrystallisation to occur. The binder metallurgy of practical hard metal materials is significantly limited and highly dominated by cobalt. This is particularly the case for tungsten carbide based hard metal materials which are generally the most highly developed and superior materials for most applications. More rarely available is titanium carbide hard metal which, however, is made mainly with nickel as the binding metal. Using tungsten carbide/cobalt hard metal material types for PCD substrates, which is overwhelmingly the normal commercial situation, thus largely restricts such conventional PCD products to cobalt based metallurgy for the metallic network in the PCD material layer. The infiltrating cobalt from such a substrate can only be alloyed with other metals to a limited extent by adding metal powders to the diamond powder layer during manufacture.

Alternatively, the prior art teaches the use of placing thin metal layers between the substrate and the diamond powder layer. This approach is also limited to available metals alloys in strip form which of course will have to be alloyed further in situ by the molten metal infiltrating from the substrate.

The present applicants have appreciated that both of the above approaches to metallurgical modification for the PCD material usually result in alloy inaccuracy and in-homogeneity in the PCD layer due to the directional infiltration of the substrate origin metal. Thus, whilst the applicants believe that in principle any combination of transition metal elements which can enable diamond crystallization may be used to form the diamond intergrowth essential for PCD materials and the resultant metal interpenetrating network, to date only a narrow set of possibilities have been conventionally exploited and these are mostly limited to cobalt as the main metallic component.

It is known that highly specific transition metal alloys with accurate compositions can exhibit special and remarkable properties, such as magnetic and thermal expansion properties. With conventional PCD made by infiltration of the metal component in total or in part from a substrate it is impractical and often impossible to specify sufficiently accurately or arrive at chosen alloys in the PCD material to exploit special and desired properties of such specific alloys.

5. Micro residual stress at the scale of the diamond grain size and associated metal between the grains arises during the drop to room pressure and temperature during the manufacturing process. This is due to the thermo-elastic mismatch between the diamond network and particular metallic interpenetrating network present. Typically, the thermal mismatch derived residual stress is the dominant effect. The elastic modulus and thermal expansion coefficient of transition metal alloys are highly dependent upon the accurate and specific alloy composition. This is true particularly for the coefficient of thermal expansion. For example in the iron/nickel system, for very specific alloys such as invar, Fe, 36% Ni, a linear coefficient minimum of 1.5 ppm ° $K^{-1}$ can be obtained which can be compared with the pure metal values of 12 and 13 ppm ° $K^{-1}$ for iron and nickel, respectively. Deviations of 0.1% by weight in this alloy can result in a doubling of the linear coefficient of expansion, showing the high sensitivity to the alloy composition. Pure cobalt has a linear coefficient of expansion of 13 ppm ° $K^{-1}$ and some of its alloys with iron and nickel also exhibit similar lowered thermal expansion behavior. The micro residual stress therefore will vary significantly from place to place in a PCD material where the alloy is inhomogeneous and not accurately determined. Thus due to the inhomogeneity and inaccuracy of metallurgy typical of the conventional PCD approach where infiltration from a substrate is employed, micro residual stress management at the scale of the diamond micro structural grain size is limited and impractical.

6. In conventional PCD, other than pressure and temperature conditions, the only real degree of freedom one has to determine the type of PCD material is to choose and specify the size distribution of the starting source diamond powder. In particular, once the diamond starting particle size is chosen, the metal content of the PCD material layer is restricted to a limited range. The latter is as a consequence of the bed or layer of diamond particles being exposed to a large reservoir of molten metal, in the normally large substrate. PCD materials with low metal contents cannot be easily accessed. Generally, in conventional PCD, the metal content of the PCD material increases inversely with the diamond particle size. Increasing the pressure of manufacture can decrease the metal content but only to a limited extent. Therefore, the resultant composition of conventional PCD material has been restricted and limited and the choice of metal content and diamond size distribution cannot be independently pre-selected and made over a wide range. The result is that the metal content for each chosen diamond size distribution is limited to a range of about 3 or 4 volume percent around the mean value which is typically about 6 volume percent for the very coarse grades and about 13 volume percent for very fine grades such as 1 micron.

Figure 4:
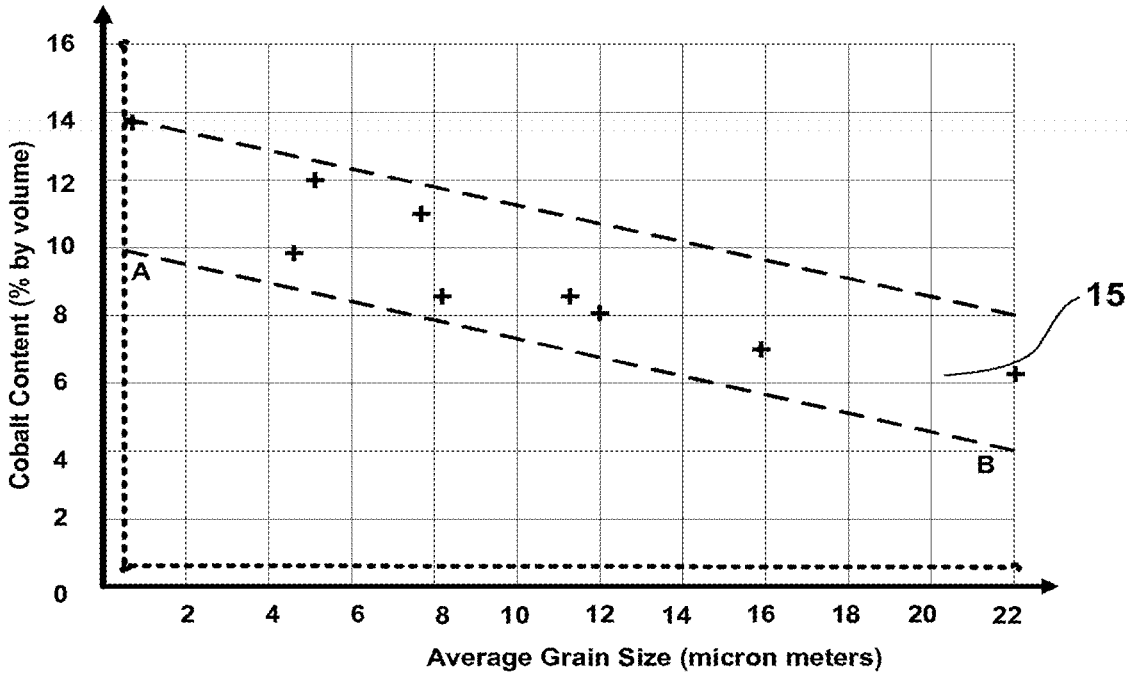
FIG. 4 is a graph of cobalt content versus average grain size of the starting diamond particles for PCD sintered by the conventional route.

This is illustrated by FIG. 4 which is a plot of cobalt content of PCD materials related to average grain size of the starting diamond particles for PCD sintered by the conventional route and shows the limited range of metal content (the field between the dashed parallel lines, region 1) typical of historical conventional PCD made with tungsten carbide hard metal substrates. FIG. 4 also shows that, after many years of development, conventional PCD is still largely confined to diamond/cobalt ratios in the band 15 between the dotted lines. This figure also shows the trend of increasing metal content with average finer grain sizes.

The present applicants have appreciated that one of the important limitations for conventional PCD is the inability to achieve very high diamond contents, i.e., low metal contents, particularly with fine diamond size distribution. A well established example of this is 1 micron PCD which has not been made conventionally with more than 86 to 88 volume percent diamond content, i.e., less than 12 to 14 volume percent metal content. It has been empirically determined in the art that increases in pressure and temperature conditions of conventional PCD manufacture are capable of lowering the metal content by about 1 to 2 volume percent. The lower limit of metal content which can readily be obtained for conventionally made PCD materials with typical historically exploited diamond particle size distributions is indicated for such historical conventional PCD materials by the lower dashed line A-B in FIG. 4. This line corresponds to the formula $y=-0.25x+10$, where y is the metal content of the PCD in volume percent, and x is the average grain size of the PCD material in micro meters. The field of metal content below this line is not conventionally accessible using the typical pressures and temperatures available with the use of the presently developed commercial high pressure high temperature equipment. As explained in numbered section 4 above, the metal or alloy composition is also conventionally limited and difficult to accurately and controllably vary. Generally, therefore, in the conventional approach, the manufacturing degrees of freedom such as grain size distribution, metal content and metal alloy are co-dependent and not readily independently pre-selected, chosen and varied.

The limitations and problems with respect to homogeneity, macroscopic and microscopic residual stresses, size and shape of the PCD body, and restricted choice of material composition described above for the prior art conventional PCD bodies or constructions gives rise to poor or inadequate performance in many applications.

The present applicants have appreciated that the development of free standing PCD bodies of any 3-dimensional shape, specifically engineered to have high material homogeneity and with an absence of macroscopic residual stress, and with an independently pre-selected greatly expanded choice of PCD material structure and composition, with attendant micro residual stress control, is highly desirable. Some embodiments described hereunder are directed at removing or ameliorating the limitations of the conventional approach to PCD bodies or constructions in which the possibility of better exploiting the true potential of PCD materials becomes viable.

The removal or amelioration of the limitations of conventional PCD materials makes the applications indicated above more viable with the potential of new applications becoming possible for PCD materials.

A free standing, single volume of PCD material is disclosed which is homogeneous and free of residual stress at a macroscopic scale greater than ten times the average grain size, where the coarsest component of grain size is no greater than three times the average grain size.

The free standing nature of this PCD volume or body arises due to the absence of a bonded substrate of a dissimilar material to the PCD. The absence of a substrate also means that the molten metal required for enabling the partial recrystallisation of the diamond particles to form the particle to particle diamond bonding does not arise from long range directional infiltration from such a substrate body. Rather, the required molten metal is provided solely by an initial homogeneous, intimate and accurate combination or mass of diamond particles and smaller, pure metal particles, grains or entities. The details of the methods employed to form such a mass of diamond and metal particles, which is homogeneous above a scale related to the average and maximum diamond particle sizes, together with the means by which the homogeneity is progressively maintained during consolidation of the mass to form a so called green body of preselected size and shape and subsequent sintering of the diamond particles at high pressure and temperature, are described below.

Figure 3:
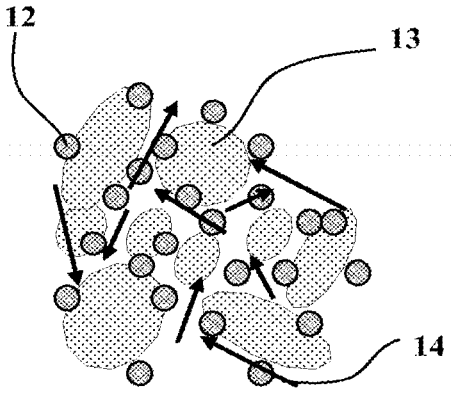
FIG. 3 is a schematic diagram of the very localised or short range movement of metal during the sintering of diamond particles to form an embodiment of PCD showing the diamond particles with well and homogeneously distributed, smaller metal particles.

When the metal particles are exposed to appropriate high pressure and temperature conditions such that the metal melts, the molten metal only permeates the surrounding interstices in the local vicinity of each diamond particle. On exposure of a mass of such diamond particle/metal combinations to these conditions, this very short range permeation of the molten metal into the surroundings of each diamond engenders high homogeneity of diamond and metal. This is illustrated in FIG. 3 which is a schematic diagram of the very localised or short range movement of metal during the sintering of diamond particles in the PCD. It shows the diamond particles 13 with well and homogeneously distributed, smaller metal particles 12. The metal movement is depicted by arrows 14 moving in all directions but only as far as neighbouring diamond particles. The high purity of the diamond metal combination also ensured by embodiments of the methods described herein helps the generation of high homogeneity so that third phase precipitates, such as oxides and tungsten carbide and the like, may be avoided.

The free standing volume or body of homogeneous PCD material is not bonded in any way to other material bodies during manufacture, be they of a dissimilar material or of a different composition and structure of PCD. Macroscopic residual stresses cannot therefore be generated during return to room pressure and temperature at the end of the manufacturing process. Such a free standing PCD body may thus be considered to be macroscopically stress free at a scale above which it is homogeneous, spatially invariant and considered to be made of one average property material. In the context of typical PCD materials, this scale may be considered to be greater than ten times the average grain size, where the coarsest component of grain size is no greater than three times the average grain size. Where the average diamond grain size is about 10 to 12 micro meters and the maximum grain size is smaller than about 40 micro meters this scale may be considered to be above 120 micro meters. Where the average diamond grain size is about 1 micro meter where the maximum grain size is about 3 micro meters, this scale may be considered to be above 10 micro meters.

The long range directional infiltration of molten metal from a substrate in conventional PCD manufacture as previously described, contributes to the dimensions of the PCD in the direction of the infiltration being limited to about 3 mm. Some embodiments ensure or assist in the maintenance of diamond and metal homogeneity at each stage of manufacture of a free standing PCD body and employ short range permeation of molten metal during the sintering stage and thereby eliminate or substantially ameliorate the above-mentioned limitation. Consequently, the dimensions possible for the free standing, stress free PCD body in any orthogonal direction is not limited in such a way. Therefore, it is believed that any desired 3-dimensional shape may be generated, which is not possible in the conventional PCD prior art. Moreover, embodiments of the methods described herein may provide near net size and shape capabilities so that accurate non distorted free standing PCD bodies may be made.

The generation of PCD having valuable general shapes where one direction in the PCD body is significantly greater than any of the dimensions at right angles to it is believed to be possible. For example, columnar structures where the cross-sectional area perpendicular to the axis is circular (cylindrical shaped), elliptical or any regular or irregular polyhedral shape can be made.

Alternatively, general shapes where one direction in the solid is significantly less than any dimension at right angles to it may also be readily made, for example, these shapes include discs and plates. The large faces of the plates may be any regular or irregular polyhedron.

The near net shape capability of some of the embodiments of the methods described herein may allow 3-dimensional solids having high degrees of symmetry to be made, such as spheres, ellipsoids (oblate and prolate) and regular solids. The regular solids may include the five so-called "Platonic" solids, namely the tetrahedron, cube, octahedron, icosahedron and dodecahedron. The thirteen semi-regular, so called "Archimedes" solids which include the cuboctahedron, truncated cube, truncated octahedron, truncated dodecahedron and truncated tetrahedron may also be made. Moreover, the generation of other convex polyhedra such as prisms, pyramids and the like are believed to be possible. In addition, PCD bodies formed as conical and toroidal shapes may be made, together with polyhedral toroidal shapes. More generally, any irregular shape where the solid is bounded by one or more non-straight edge and one or more non-flat surface may be possible. All of the 3-dimensional solid shapes described above, be they of high symmetry or irregular may be modified by forming concave re-entrant surfaces. Such re-entrant surfaces may be bounded by flat polygonal faces, curved surfaces, irregular surfaces or any combination of these. Re-entrant surfaces may have particular value where the free standing body is required to be mechanically attached to a foundation or another body. For example, a circumferential groove may facilitate the use of a split ring for interlocking purposes.

Practical dimensions for such 3-dimensional shaped free standing PCD bodies will however be limited by the dimensions and design characteristics of the high pressure high temperature apparatus used to manufacture them. Large high pressure high temperature systems with a sample volume of greater than 1.0 litre and with high pressure reaction volumes of dimensions as large as 132 mm in diameter, have been disclosed in the technical literature (Ref. 5). More recently, it has been established in the art that high pressure systems with reaction volumes of 2.0 litres or more are viable. Such systems may be either multi-axial (such as cubic) systems or belt type system, both of which are known in the art. The latter belt type systems are favoured and are practically more amenable to large reaction volumes because of their ability to maintain pressure by accommodating large volume changes during the reaction processes.

Free standing PCD bodies made with in accordance with some embodiments of the method described herein may be made such that the largest dimension in any direction in the body may fall within the range 5 to 150 mm. For example, a free standing PCD body consisting of a right circular cylinder of 100 mm diameter and 100 mm long will have the largest dimension along a body diagonal of 141.4 mm. Another example is a free standing PCD cube of edge length 85 mm, which has a face diagonal of 120.2 mm and a body diagonal of 147.2 mm. Another example of a small free standing PCD right circular cylinder which has its largest dimension within the quoted range, has a diameter of 4 mm and a length of 4 mm and a body diagonal of 5.66 mm.

Another serious practical difficulty appreciated by the present applicants leading to limitations in the conventional PCD prior art is the limited metallurgical scope derived from infiltration from a substrate. This is true even when metal powders are added to the PCD starting diamond. The inherent metallurgical inhomogeneity characteristic of the conventional PCD approach which is a result of directional infiltration of the required molten metal in turn results in an inability to permit creation and choosing of accurate and specific alloy compositions which are the same from place to place across the volume of the PCD material. Indeed it is also very difficult for even the diamond to metal ratio to be invariant across the dimensions of the PCD volume or layer. It is well known that the properties of alloys are usually highly dependent upon very specific and accurately made compositions. Moreover, PCD materials themselves exhibit properties very dependent upon accurate compositions. The general consequence therefore of this for conventional PCD is that the true scope of composition and therefore properties cannot be uniformly achieved across the dimensions of the conventional PCD volume or layer.

In contrast, some embodiments of the methods described herein are unfettered by such inhomogeneity and inaccuracy problems of composition as very accurate and specific wide ranging alloy compositions may be chosen and made invariant across the dimensions of the free standing PCD volume.

The accuracy in diamond-to-metal ratio characteristic of some embodiments of the methods described herein results from the metal or alloy being smaller than the diamond particle sizes, and being homogeneously distributed and associated with each diamond particle. This is particularly true for the method where the metal(s) or alloy(s) of choice are decorated onto or associated with the surface of each individual diamond particle of the starting diamond powder. During the high pressure high temperature phase of the manufacturing process where the metal on each of the diamond particle surfaces is melted, the molten metal permeates the interstices between the diamond particles to a very limited range between the surrounding particles. This ensures that the chosen diamond to metal ratio is constant and invariant across the dimensions of the free standing PCD body and homogeneous at a macroscopic scale. The scale above which this homogeneity and invariance of composition occurs is dependent upon the grain size distribution of the PCD material and is smaller for smaller average grain sizes. For example where the average grain size is 1 micro meter and the maximum grain size is about 3 micro meters the material can be considered to be homogeneous and spatially invariant above about 10 micro meters. More generally, the macroscopic scale above which the PCD material is considered to be spatially invariant may be defined as at a scale greater than 10 times the average grain size, where the largest grains are no more than 3 times the average grain size.

The accuracy of the alloy composition in some embodiments described herein may be achievable as a consequence of the use of molecular precursors for the chosen metals in the methods described herein. Some of the molecular precursors such as nitrate or carbonate salts of the metals may be made as mixed crystals or solid solutions. This is possible in the cases where the metal salts are isomorphous, i.e., having the same crystallographic structure. In particular, this is true for the carbonates of some transition metals such as iron, nickel, cobalt and manganese. Where the mixed molecular precursor is chemically generated or precipitated by reacting a solution of soluble salts or compounds, the accuracy of the specifically chosen metallic element ratio may be determined by easily provided concentration ratios of the solutions of the source compounds of the chosen metals. One of the examples of this is to create a combined mixed solution of metal nitrates in water and then to precipitate a mixed carbonate precursor for the chosen alloy by reaction with sodium or ammonium carbonate solutions. The use of mixed molecular precursors in this way enables the chosen metal elements to be combined at an atomic scale. In contrast, the conventional approach to PCD manufacture necessarily involves alloying by virtue of melts, flowing and diffusing together which always results in spatial variation and inaccuracy.

Precursor compounds which may be dissociated and/or reduced to metals and alloys are readily available for nearly all the metals of the periodic table. Those precursors which can be reduced to metals or metal carbides by reaction with carbon may be preferred. In particular, the metals of Group VIIIA of the periodic table can be exploited individually or in fully alloyed combinations. The metals chosen wholly or in part must however be capable of facilitating diamond crystallization in order to create the necessary diamond particle to particle bonding for PCD. An important implication of this is that the resultant metallic network of the PCD material has carbon in solid solution usually to a maximum level as expressed in appropriate metallurgical phase diagrams. In addition, metallic elements which readily form stable carbides will also be present in the metallic network as carbide components. Thus, the metal alloys exploitable in PCD are the high carbon versions of such metals.

The free standing PCD bodies of some embodiments described herein due to the high homogeneity and accuracy of composition may thus exploit the special properties of highly specific chosen compositions. For example, the metallic network may be chosen to be made from controlled expansion alloys which have highly specific elemental ratios. The thermo elastic properties of the metallic network may therefore be chosen to be specific from a wide range but, due to the homogeneity, be the same at all parts of the free standing PCD body. The range of linear coefficient of thermal expansion for the metallic network extends from magnitudes typical of elements such as cobalt (13 ppm $^\circ K^{-1}$ at room temperature) to that typical of low expansion alloys like the high carbon version of Invar (Fe, 33% Ni, 0.6% C, about 3.3 ppm $^\circ K^{-1}$ at room temperature, ref 4). By accurate choice of the metallurgy of the metallic network the difference in thermo elastic properties between the diamond network and the inter-penetrating metallic network may be accurately chosen and determined. Together with the metal content which may be independently chosen, such differences in the thermo elastic properties of the two inter-penetrating networks generate residual stresses at the scale of the microstructure during the quench to room conditions at the end of the manufacturing process. If the dominant stress generating effect is due to the thermal shrinkage difference and the diamond expansion coefficient, which is about 1 ppm ° $K^{-1}$ at room temperature, the diamond network will be generally compressively stressed and the metallic network generally under tension. The magnitude of this micro residual stress may be considered to be high when the linear coefficient of expansion of the metallic network is 10 to 14 ppm ° $K^{-1}$, medium for a linear coefficient of expansion of 5 to 10 ppm ° $K^{-1}$ and low for less than 5 ppm ° $K^{-1}$. Where the PCD body is homogeneous at a macroscopic scale as previously defined, these micro residual stresses sum to zero, resulting in the macroscopic residual stress being considered to be zero and the free standing PCD body itself to be macroscopically stress free. When alloys with a coefficient of linear thermal expansion of less than 5 ppm ° $K^{-1}$ are used the differences in elastic modulus between the alloys and diamond become more significant and the micro residual stress in the metallic network may in fact become compressive. Low expansion alloys such as iron, 33 weight % nickel, 0.6 weight % carbon which has a literature value of elastic modulus and coefficient of linear thermal expansion of 150 GPa and 3.3 ppm ° $K^{-1}$, respectively, are examples of such alloys.

PCD bodies where the micro residual stress in the metallic network has an overall compressive nature form some embodiments and are now disclosed.

The understanding of the present applicants is that micro residual stresses play a significant role in crack initiation and local crack coalescence during mechanical applications of PCD materials. This may be considered as a key aspect of wear behaviour at the particle to particle level. Materials with a low propensity of micro cracking may hence be developed using the approach and methods described herein.

The ability to independently choose and pre-select the metal content and metallurgical type of the PCD material for the purpose of micro structural stress management as discussed above is an example of an important and distinct character of some embodiments, namely, the ability to independently choose and control the structural and compositional variables.

Unlike in the conventional infiltration from a substrate PCD approach where initial choice of diamond particle size and size distribution largely fixes or radically limits other variables, the method of some embodiments described herein allows independent choices and control of these variables and also the homogeneity of the end products to be specifically engineered to be high. For example the metal content, metal type, diamond size and size distribution may be independently chosen and controlled. As can be seen in FIG. 4, conventionally when fine grain PCD of about 1 micron average grain size is made by infiltration of metal from a hard metal substrate, the metal content is restricted to about 12 to 14 volume percent.

In contrast, some embodiments described herein provide for the metal content to be chosen independently to the metal type and be anywhere in the range from about 1 to 20 percent. Similarly, where a multimodal grain size is chosen for the embodiments of a PCD body described herein and the average grain size is about ten micro meters with the maximum grain size about 30 micro meters, again the metal content may be chosen anywhere in the range from about 1 to about 20 percent. The metal content for conventional PCD material being restricted to around and close to 9 volume percent, as illustrated in FIG. 4, no longer applies. The field of metal contents below the lower dashed line A-B in FIG. 4 which correspond approximately to the formula $y=-0.25x+10$ where y is the metal content in volume percent and x is the average grain size of the PCD material in micro meters, may therefore be exploited using the methods described herein and embodiments of free standing PCD bodies with metal contents in this field are envisaged.

The metallic network may be chosen to be most combinations and permutations of the metals of the periodic table provided that diamond crystallization can be facilitated by such metals, which also means that the alloys all have a high carbon content. This choice is made completely independently of average grain size, grain size distribution and diamond to metal ratio. Clearly, a greatly extended range of PCD material types with their attendant properties can now be accessed. Yet another feature of some embodiments described herein is that the element tungsten will be absent unless deliberately included. This is in contrast to the dominant custom and practice of the conventional prior art PCD approach where tungsten carbide/cobalt hard metal substrates are used which inevitably result in tungsten being inhomogeneously incorporated as tungsten carbide precipitates in the PCD layer. Some embodiments of the methods described herein assist in allowing the incorporation of tungsten carbide as an added phase at controllable and homogeneous levels if such compositions are chosen. Typically, PCD compositions free of tungsten may, however, readily be made.

The metals and alloys which are capable of facilitating diamond crystallization after melt, include any of and any combined permutations or alloys of the transition metals of the periodic table whereby at least one metal does not form stable carbide compounds at conditions of temperature and pressure appropriate for diamond crystallization. Typical of these latter metals and preferred for diamond crystallization processes are the Group VIIIA metals of the periodic table such as iron, nickel, cobalt and also the Group VIIA metal manganese. Transition metals which form stable carbides under typical diamond re-crystallization from metal solutions conditions include tungsten, titanium, tantalum, molybdenum, zirconium, vanadium, chromium and niobium. Some embodiments described herein allow the metallic network in the PCD body to be accurately chosen combinations of iron, nickel, cobalt or manganese with the carbides of these elements. Notably, cobalt, tungsten carbide (WC) combinations ranging from high cobalt content to low cobalt content may be provided by some embodiments of these methods.

A further feature some embodiments occurs as a result of the absence of macroscopic residual stress, in that manufacturing pressure and temperature conditions may be widely chosen as undesirable residual stress distributions from such pressure and temperature choices does not occur. The conventional PCD approach suffers from significant increases in residual stress distributions as higher pressures and temperatures are used causing a high incidence of cracking and fracture of the PCD parts during manufacture. Thus, the approach of some embodiments described herein may allow the ready beneficial use of higher pressures and temperatures. The benefits may include increased intergrowth of diamond particles and associated property improvements such as increases in hardness, strength and thermal properties with increased diamond to metal ratio. When striving for PCD materials confined to particularly low metal contents such as 1 or 2 volume percent, the convenience of using increased pressures and temperatures may allow fully dense PCD material to be achieved.

Some embodiments of methods for producing free standing PCD bodies are described in detail below which covers means of creating particulate masses of diamond and metals and alloys, followed by techniques to consolidate these masses into green bodies of pre-determined shapes and sizes and finally subjecting the green bodies to high pressure high temperature conditions in order to sinter the diamond particles.

Methods to produce the free standing, three dimensional PCD body or construction, of any shape and up to about 100 mm in any dimension, which is macroscopically homogeneous in structure and composition and stress free at a macroscopic scale are described. This macroscopic scale is dependent upon the grain size distribution of the PCD material and defined to be greater than ten times the average grain size, with the maximum grain size being about three times the average grain size. For most typical so called coarse grain sized PCD materials this is greater than about 0.2 mm (200 micro meters). For very fine grained PCD materials close to an average of 1 micron, this scale is above about 10 micro meters. In order to achieve this, means of combining diamond powders of predetermined particle size distribution with metals or metal alloys at least one of which is capable of facilitating diamond crystallization are required. Typically, but not exclusively, diamond powders with an average particle size of less than 20 micro meters may be used. After melting the metals in a consolidated mass of the combined diamond particles and metals, at appropriate pressure and temperature conditions, the molten metal only permeates the mass from each diamond particle into the regions between immediately surrounding particles. This short range permeation or infiltration is thought to contribute to and ensure the homogeneity of the PCD body and in turn may provide for the PCD body to be macroscopically stress free.

The approaches and means used to make the mass or combination of diamond powder and appropriate metals and alloys for subsequent sintering of the diamond particles at high pressure and temperature, may provide homogeneity in diamond size distribution, diamond to metal distribution and metal composition. This homogeneity of the powder mass or combination may then provide for the homogeneity of the final sintered PCD material body. Further, this may be facilitated if, preferably, the form of the metals or metal alloys is of metal particles, grains or entities which are smaller than the size of the diamond particles for each chosen size or size range of diamond particles required to produce PCD with a chosen desired grain size distribution.

Figure 5:
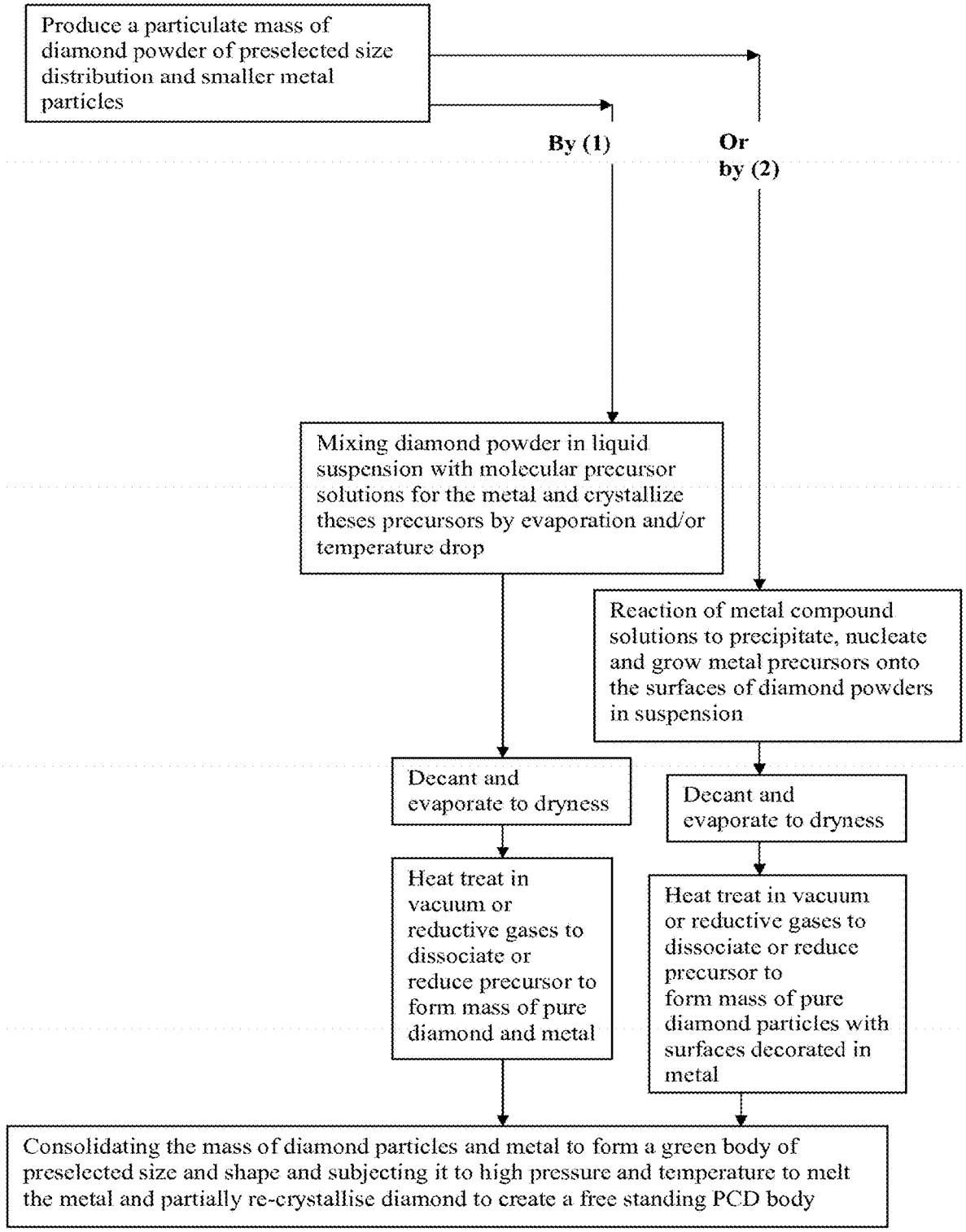
FIG. 5 is a generalized flow diagram showing two alternative approaches of embodiments of the method and preferences, laid out in two columns, for combining diamond powders with appropriate metals to form a mass of particulate material, which after forming into a 3-dimensional semi-dense body is subjected to high temperature and pressure conditions to melt or partially melt the metal and partially re-crystallize the diamond to create the free standing PCD body.

FIG. 5 is a generalized flow diagram showing alternative approaches and preferences for combining diamond powders with appropriate metals to form a mass of particulate material which, after forming into 3-dimensional semi-dense so-called "green" bodies, is subjected to high temperature and pressure conditions to melt or partially melt the metal and partially re-crystallize the diamond to create the free standing PCD bodies.

Methods according to one or more embodiments of creating a starting mass of combined diamond particles and smaller metal(s) or alloy(s) make use of precursor compounds, which may be dissociated or reduced to form the sufficiently pure metals and alloys by heat treatment in controlled environments. Examples of such environments include vacuum or appropriate gases which have reducing gases present such as hydrogen or carbon monoxide and the like. These precursors include compounds such as salts, oxides and organometallic compounds of the transition metals or any chemical compound which can be dissociated and or reduced to yield at least one of the required metals. For final alloy formation these precursors may be mixed. Alternatively, individual precursor compounds which contain the elemental combination of the desired alloys may be used, for example, mixed salts such as iron nickel cobalt nitrates, $Fe_xNi_yCo_z(NO_3)_2$ where x+y+z=1, and the like. This will engender highest accuracy of final alloy atomic composition and homogeneity.

Ionic compounds such as salts which can be dissociated and/or reduced to form pure metals may be examples of candidates for precursors. Examples of some such salts are nitrates, sulphates, carbonates, oxalates, acetates and hydroxides of the transition metals.

Of particular interest for some embodiments are the oxalates of cobalt and nickel, $CoC_2O_4$ and $NiC_2O_4$ which decompose to the metal in inert atmosphere, such as nitrogen, at very low temperatures and above such as 310 and 360° C., respectively (Ref 1). Such oxalates may be used in hydrated form, e.g. crystals of $CoC_2O_4.2H_2O$ and $NiC_2O_4.2H_2O$ or dehydrated form.

Nitrate salts, in particular cobalt(II) nitrate hexahydrate crystals, $Co(NO_3)_2.6H_2O$, nickel nitrate hexahydrate crystals, Ni(II) $(NO_3)_2.6H_2O$ and ferrous iron(II) nitrate hexahydrate crystals, $Fe(NO_3)_2.6H_2O$, respectively, may, in some embodiments, be preferred as crystallized precursors for the specific metals. Such nitrate crystals are easily dehydrated and dissociated at low temperatures approaching 200° C. and reduced to the pure metals above temperatures as low as about 350° C. in hydrogen containing gaseous environments (Ref. 2 and 3).

Alloy compositions may be obtained by mixing the salts or by the use of mixed metal single compounds such as mixed salts. For example co-crystallized nitrates of iron, cobalt and nickel to form mixed crystals such as $Fe_xCo_yNi_z(NO_3)_2$ where x+y+z=1. One advantage of using such mixed salts may be that, on dissociation and/or reduction to the metallic state, the metals will already be mixed at the atomic scale, engendering maximum homogeneity in regard to alloy composition.

Carbonates are also excellent precursors for metals such as iron, nickel, cobalt, copper and manganese. On thermal dissociation and reduction these salts form particularly finely sized metals, often down to a few tens of nanometers.

When metals such as cobalt, nickel, iron, manganese or copper, are desired to be combined with metals which form stable carbides during decomposition/reduction and/or diamond sintering, such as tungsten, molybdenum, chromium, tantalum, niobium, vanadium, zirconium, titanium and the like, a useful approach is to use ionic compounds where the former metals form the cation and the latter carbide forming metals form part of the anion, such as in tungstates, molybdates, chromates, tantalates, niobates, vanadates, zirconates and titanates, respectively. Some important examples of such compounds are cobalt tungstate, $CoWO_4$, nickel molybdate, $NiMoO_4$ and cobalt vanadate, $Co_3(VO_4)_2$, respectively.

Intermetallic compounds such as CoSn may also be made by dissociation/reduction of precursors such as cobalt stannate, $CoSnO_3$.

Examples of oxides which may be used include ferrous and ferric oxide ($Fe_2O_3$ and $Fe_3O_4$), nickel oxide (NiO), cobalt oxides (CoO and $Co_3O_4$). The latter oxide, $Co_3O_4$, may be produced as micro meter sized aggregates of 20 to 100 nm particles by the decomposition of cobalt carbonate in air at low temperatures such as 300 to 400° C. For final alloy formation, these precursors may be mixed.

Other precursor compounds for the metal(s) or alloy(s) may be crystallized from solution in liquids where the diamond powder is present as a solid suspension, FIG. 5 column 1. Some precursor compounds are soluble in solvent liquids such as water or alcohols and may be crystallized from such solutions by reduction of temperature and/or evaporation of the solvent or protocols known in the art of crystallization from solution, where suitable degrees of supersaturation and or seeding may be exploited.

Stable suspensions of desired diamond particle size distributions anywhere in the range of 0.1 to greater than 30 micro meters may be obtained when in water or alcohol, particularly when the suspension is vigorously stirred. After appropriate settling and decantation followed by drying procedures, a combination of solid precursor(s) for the metal and diamond results. The crystallization of the precursor is organized such that the particle or crystal size is smaller than that of the diamond powder. Subsequently, dissociation and/or reduction of the precursor by heat treatment in vacuum or reductive gases generates a mass of diamond and smaller sized metal particles, grains or entities. Approaches where diamond suspensions are used, particularly when they are continuously stirred, may engender excellent homogeneous mixing with crystallized precursors. The liquid suspension medium for the diamond and solvent for the precursor compounds may be water or alcohols such as ethanol and the like or any appropriate and convenient liquid. Where pure water is used, preferred precursors for the metals are salts and in particular nitrates. This is because all metal nitrates have a high solubility in water and may readily be thermally dissociated and/or reduced to the pure metal by low temperature heat treatment. Again, in particular cobalt (II) nitrate hexahydrate crystals, $Co(NO_3)_2.6H_2O$, nickel nitrate hexahydrate crystals, Ni(II) $(NO_3)_2.6H_2O$ and ferrous iron(II) nitrate hexahydrate crystals, $Fe(NO_3)_2.6H_2O$, respectively, may be used, for example, as crystallized precursors for the specific metals. Such nitrate crystals are easily dehydrated and dissociated at low temperatures approaching 200° C. and reduced to the pure metals above temperatures as low as about 350° C. in hydrogen containing gaseous environments (Ref 2 &3). In addition, many of the metal nitrates may be co-crystallized as mixed crystals whereby atomic scale mixing of extremely accurate alloys may be achieved on dissociation and reduction to the metallic state.

Another class of precursor compounds for this approach are the oxalates, $M_x(C_2O_4)_y$, x and y being dependent upon the valency of the metal M, as the anion is $(C_2O_4)^{2-}$. Examples of oxalate salts which may be used include cobalt oxalate dehydrate crystals, $Co(II)C_2O_4.2H_2O$, nickel oxalate dehydrate crystals, $Ni(II)C_2O_4.2H_2O$ and ferrous iron oxalate dehydrate crystals, $Fe(II)C_2O_4.2H_2O$. Ferric oxalate pentahydrate crystals, $Fe(III)_2(C_2O_4)_3.5H_2O$ may also be crystallized and used in this approach. These compounds may be very easily decomposed and/or reduced to the pure metal at low temperatures (Ref 1).

Transition metal acetate crystals may also be used in this approach, such as cobalt acetate quadrahydrate, Co(II) $(C_3H_3O_2)_2.4H_2O$, nickel acetate quadrahydrate, Ni(II) $(C_3H_3O_2)_2.4H_2O$ crystals and ferrous iron acetate quadrahydrate, $Fe(II)(C_3H_3O_2)_2.4H_2O$ crystals.

Superior accuracy and homogeneity of diamond to metal composition ratio, metal alloy composition and purity may be possible using the above described method.

Another approach to creating a mass or combination of diamond powder and metal(s), however, involves chemical reaction(s) to form and/or precipitate the precursor compound(s) for the metal in liquid in the presence of diamond powder in suspension, as shown in FIG. 5 column 2. Here the precursor is significantly insoluble in the chosen suspension liquid. The reactants to form the precipitated precursor are introduced into the diamond suspension by adding solutions of soluble compounds. One or more of these solutions is a source of the desired metal or metals.

Figure 6:
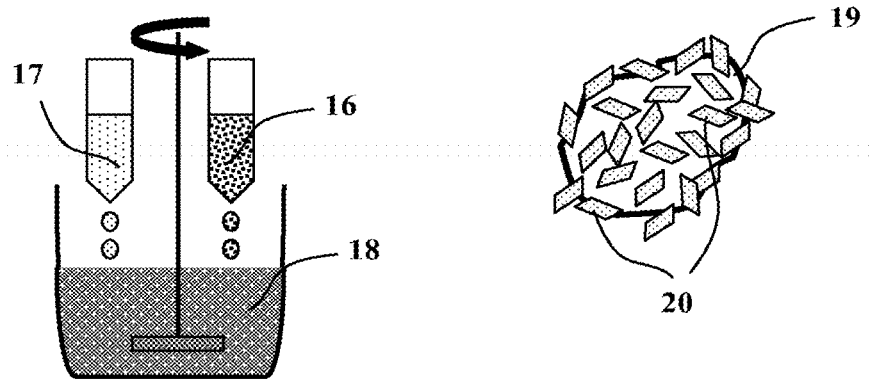
FIG. 6 is a schematic diagram for the method of FIG. 5 column 2.

FIG. 6 is a schematic diagram for this approach and illustrates a solution of a compound which is a source of metal atoms or ions, 16, is simultaneously added together with a solution of reactants, 17, to a continuously stirred suspension of diamond powder, 18. The metal source compound and reactant from solutions 16 and 17 react to form precipitate crystals or compounds which nucleate and grow on the diamond particle surfaces. These crystals or compounds then decorate the diamond surfaces and are precursor(s) for pre-selected metal particles. A representative diamond particle, 19, is illustrated with a precursor compound, 20, which decorates the particle surface. Notable examples of this approach may have the feature of the nucleation and growth of the precursor compound on the surface of the diamond particles. In this way the precursor compound(s) for the metal are attached to the diamond surfaces and may be said to decorate said surfaces. Often the precursor is discretely distributed and does not form a continuous coating of the diamond particle surfaces. Some precursors may however form continuous coats on the diamond surfaces but on dissociation and reduction to the metallic state, the metal particles are discrete and discontinuously distributed and decorate the diamond surfaces. Examples of the latter are amorphous oxides formed by reaction of metal alkoxides with water, elaborated upon below.

To enhance the behavior of nucleation and growth of the precursor(s) on the surfaces of the diamond particles, the surface chemistry of the diamond particles may be deliberately chosen and produced to suit the nucleation of the precursor(s). When the precursor compound being precipitated has an oxy-anion such as $CO_3^{2-}$ or $OH^-$, or is formed by polycondensation, hydrophilic diamond surface chemistries based upon oxygen species such as —OH, —C═O or —C—O—C— and the like are appropriate. Means of accentuating such diamond surface chemistries are well known in the art and include high intensity ultrasound treatment of the diamond in water. FIG. 6 includes a schematic representation of a diamond particle with the surface decorated in a crystalline precursor compound.

Figure 7:
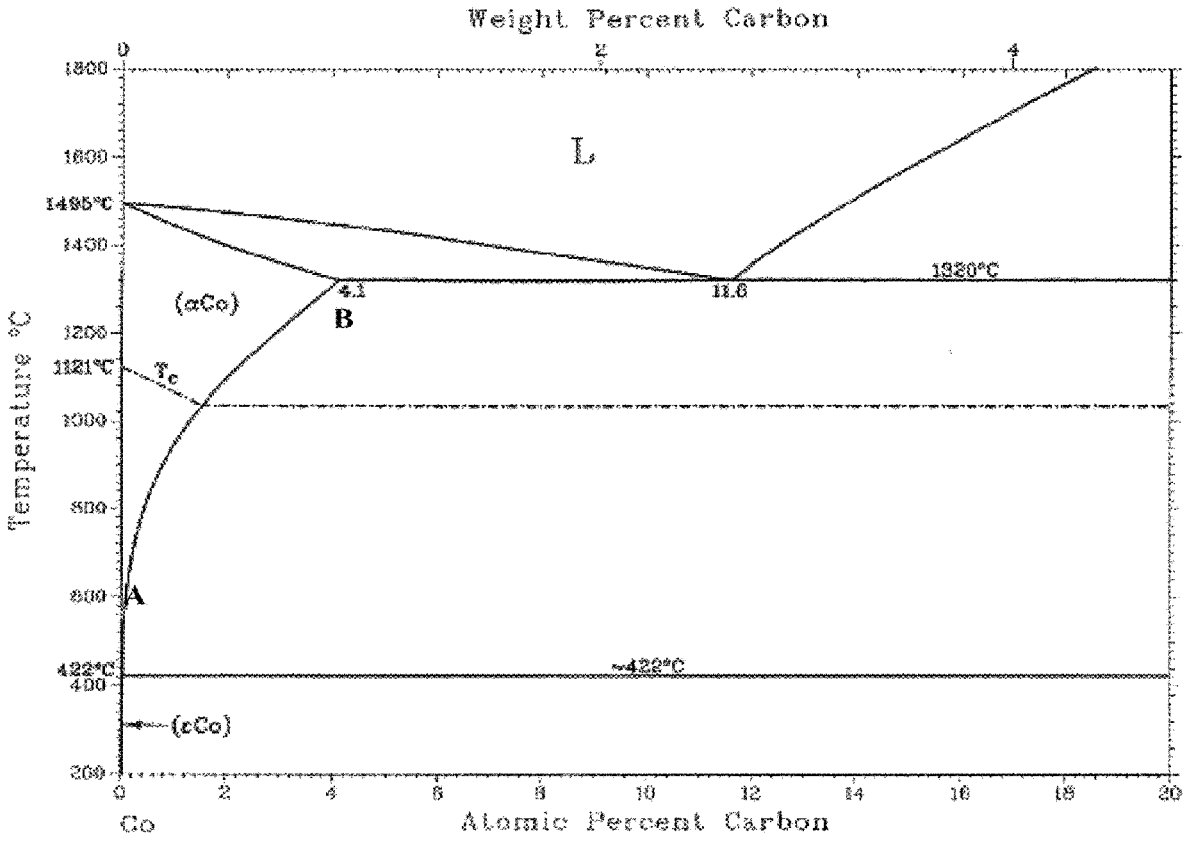
FIG. 7 is a cobalt, carbon binary phase diagram.

The precursor compound being a surface decorant or coating, means that the carbon at the diamond surface in contact with the precursor may act as an efficient reducing agent for the metal precursor compound on subsequent heat treatment. This carbothermal reduction of the precursor may be used solely or in conjunction with other dissociative or reductive steps such as the use of hydrogen gas as reducing agent. Where the precursor materials are in intimate contact with the diamond surfaces as is the case with this approach, the resultant metal will take in carbon from the diamond surface and contain carbon in solid solution. Stable carbides may also form at such conditions. The amount of carbon in solid solution in the metal decorant is highly dependent upon the temperature chosen for dissociation and reduction of the precursor. A guide to the carbon content to be expected for particular metals and alloys can be obtained by regard to the literature phase diagrams of the particular metal and alloy with carbon. By way of example to illustrate this, consider FIG. 7, which is the binary cobalt, carbon phase diagram. The line labeled AB is the solid solubility limit of carbon in solid face-centred-cubic cobalt. If the dissociation, reduction of a precursor for cobalt to obtain the metal is carried out at 700° C., the carbon content of the resulting cobalt metal will be given by this line at 700° C., namely about 0.2 atomic percent carbon, similarly if the dissociation, reduction is carried out at 1050° C., the carbon content of the cobalt will be about 0.8 atomic percent carbon. On quench to room conditions these carbon contents may be metastably maintained. Thus the carbon content of the resultant metal on the diamond surfaces may be chosen and predetermined.

Moreover, if the heat treatment conditions are maintained at the chosen temperatures for time periods of sufficient length, the carbon in solid solution in the metal may diffuse through the metal decorating the surface and progressively transport carbon from the diamond surface and come out of solution at the metal surface, forming a deposit of non-diamond carbon. When this occurs, by choice of temperature and time of the heat treatment, chosen and controlled predetermined amounts of amorphous and or nano-crystalline non-diamond carbon may be generated on the metal surfaces. This non-diamond carbon component of the starting diamond metal particulate mass may contribute to the efficient crystallization of diamond which bonds the diamond particle or grains together in the final PCD body.

Superior, especially well inter-grown diamond networks may be produced by control of such a non-diamond carbon component of the starting mass. Lower temperature conditions for short periods may also be chosen, guided by the appropriate metal, carbon phase diagram so that the non-diamond carbon is low or absent.

Figure 8:
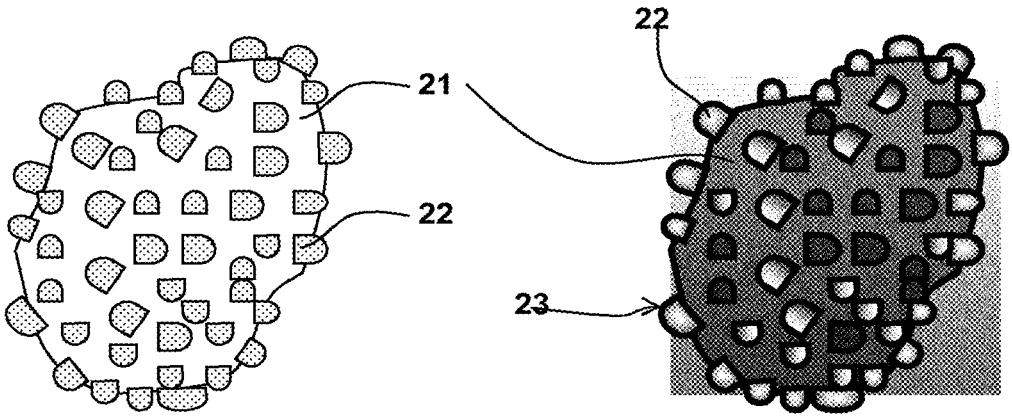
FIG. 8 is a schematic representation of a diamond particle showing metal particles decorating the surface.

FIG. 8 shows schematic representations of a diamond particle 21 and metal particles decorating the surface 22 thereof. The metal particles may comprise grains or other entities without and with significant amounts of non-diamond carbon. The metal particles may have their surfaces covered in amorphous non-diamond carbon, 23, dependent on the choice of dissociation, reduction temperature. Temperatures chosen near A in FIG. 7 do not result in detectable non-diamond carbon. Temperatures chosen near B in FIG. 7, result in significant formation of non-diamond carbon, which cover the metal particles.

A character of the metal decorant particles, grains or entities which result from this preferred approach is that they are much smaller than the diamond particles themselves and do not form a continuous metal coating. The metal decorants are typically from about 10 to just over 100 nm in size. This may allow very fine, so called sub-micron diamond particle sizes, from 0.1 to 1 micro meter to be accurately and homogeneously combined with chosen metals. This may provide a means of making PCD bodies of extremely fine diamond grain size less than 1 micro meter.

A further benefit of this diamond suspension technique is that it may be readily and conveniently scaled to that required by commercial PCD manufacturing, where batch quantities of several kilograms may be required. This may be done by appropriate choice of suspension vessel sizes in conjunction with, where necessary, heat treatment furnace designs capable of continuous operation.

The following are examples of some chemical protocols for some metals which may be exploited using this reaction based precursor compound generation approach, where the precursor nucleates and grows on the diamond surface. These are examples only and are not intended to be limiting.

Cobalt is the historically dominant metal used in PCD material. A very convenient source solute for cobalt is crystalline pure cobalt nitrate salt, $Co(NO_3)_2.6H_2O$. This is due to cobalt nitrate's very high solubility in both water and ethyl alcohol, which are possible solvents and suspension liquids for some embodiments of the method. Cobalt nitrate in solution reacts with sodium or ammonium carbonate solution, $Na_2Co_3$ or $(NH_4)_2CO_3$, respectively to precipitate cobalt carbonate crystals, $CoCO_3$, as indicated in equation (1) below for the sodium carbonate case.

$$Co(NO_3)_2soln + Na_2CO_3sol\,n \xrightarrow[\text{suspension}]{H_2O\ \text{diamond}} CoCO_3\downarrow + 2NaNO_3soln \quad (1)$$

More generally, the nitrate solutions of any of the transition metals of the periodic table may be reacted with sodium or ammonium carbonate solution to precipitate and decorate the surfaces of diamond particles in suspension with corresponding water insoluble metal carbonates. The reaction with different transition metal nitrate solutions may be carried out sequentially or simultaneously. A mixture of solutions of nitrates may also be employed to precipitate mixed carbonate crystals, such as $Fe_xNi_yCo_zCO_3$ where x+y+z=1.

Figure 9A:
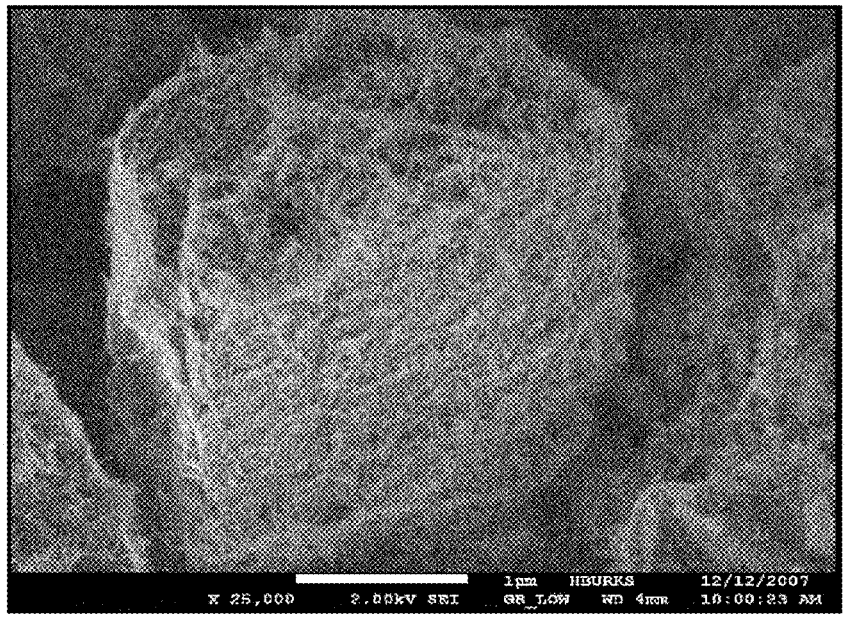
FIGS. 9*a* and 9*b* are SEM micrographs of whisker-like crystals of cobalt carbonate decorating the surfaces of 2 micro meter sized diamond particles.
Figure 9B:
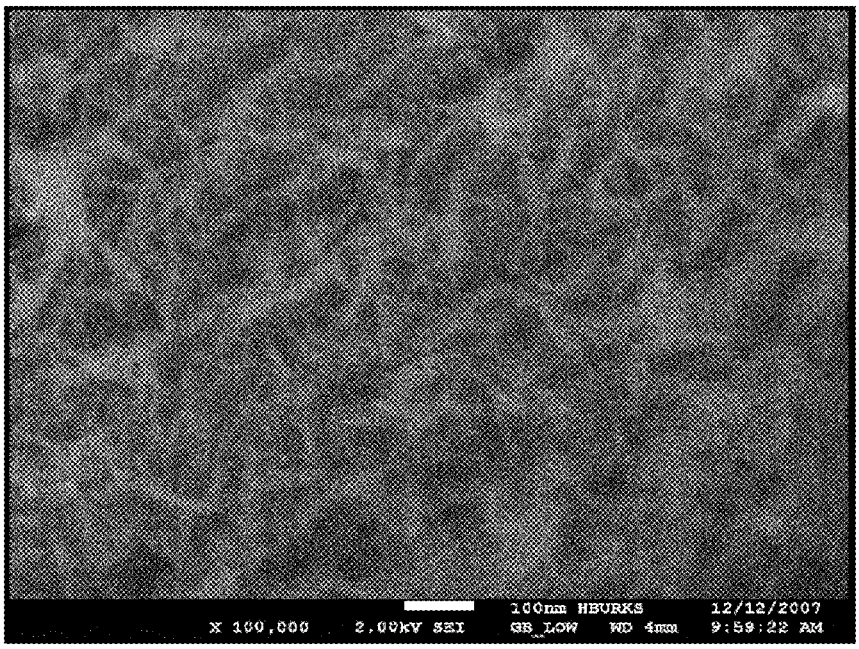

FIGS. 9*a* and 9*b* are scanning electron microscope (SEM) images of a 2 micro meter diamond particle which has been decorated in very fine, approximately 100 nm long, whisker like cobalt carbonate crystals. Whisker-like crystals of cobalt carbonate are shown as decorating the surfaces of 2 micro meter sized diamond particles. Cobalt carbonate is a precursor compound for cobalt metal.

In order to form cobalt metal as a particulate decoration on the diamond particle surfaces, such cobalt carbonate decorated diamond particles may be heated in, for example, a flowing gas mixture of 10% hydrogen in argon, at a constant temperature chosen in the range 500 up to 1320° C., for time periods of from several tens of minutes to a few hours. If the temperature is maintained below about 850° C. for a chosen short time, no non-diamond carbon can be detected.

Figure 10A:
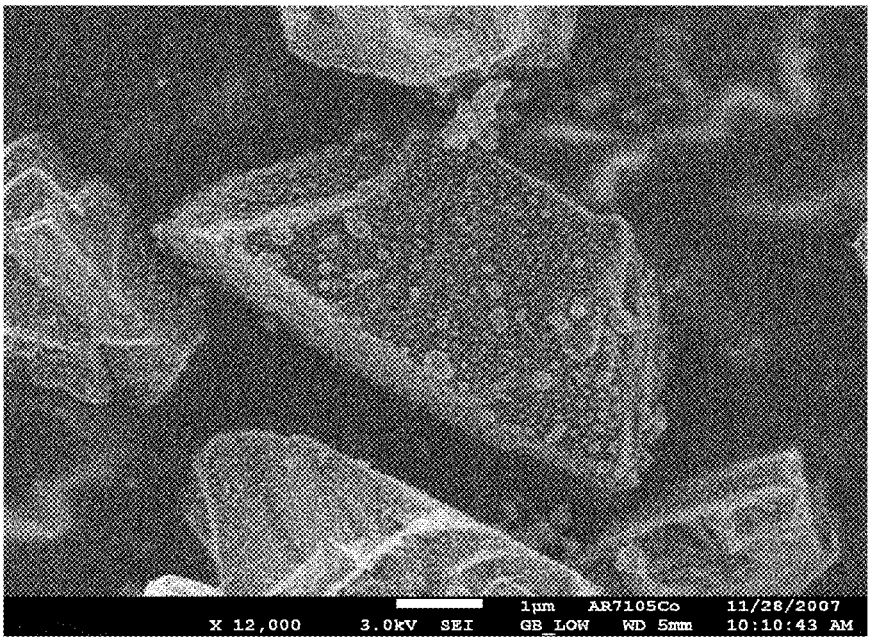
FIGS. 10*a* and 10*b* are SEM micrographs of cobalt metal particles decorating the surfaces of 4 micro meter sized diamond particles.
Figure 10B:
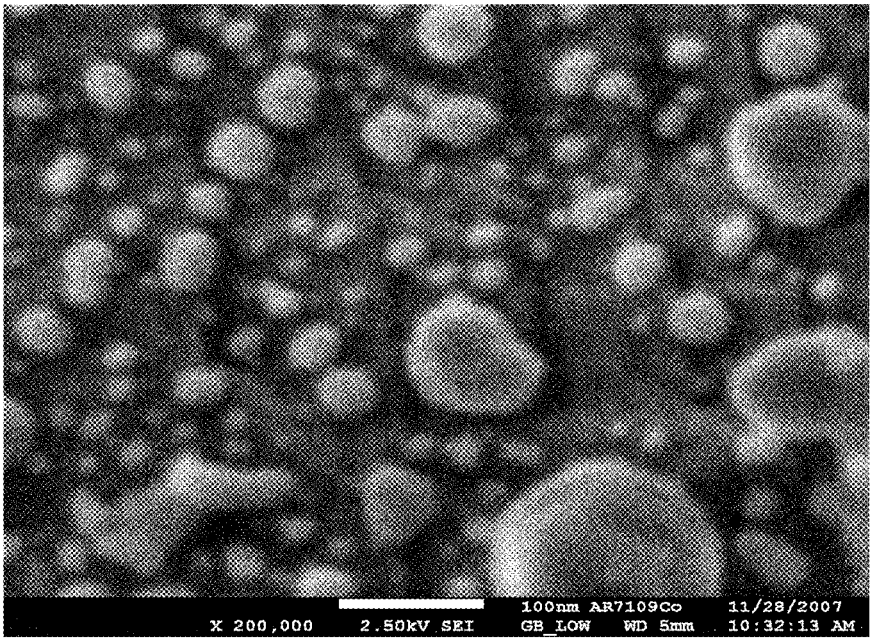

FIGS. 10*a* and 10*b* are SEM images of 4 micro meter sized diamond particles decorated in about 22 weight % (10 volume %) cobalt after reduction in 10% hydrogen argon gas mixture at 850° C. The cobalt metal decorating particles or grains vary from about 10 to 120 nm in size. In this embodiment, no non-diamond carbon could be detected with SEM or transmission electron microscope (TEM) techniques.

Figure 11:
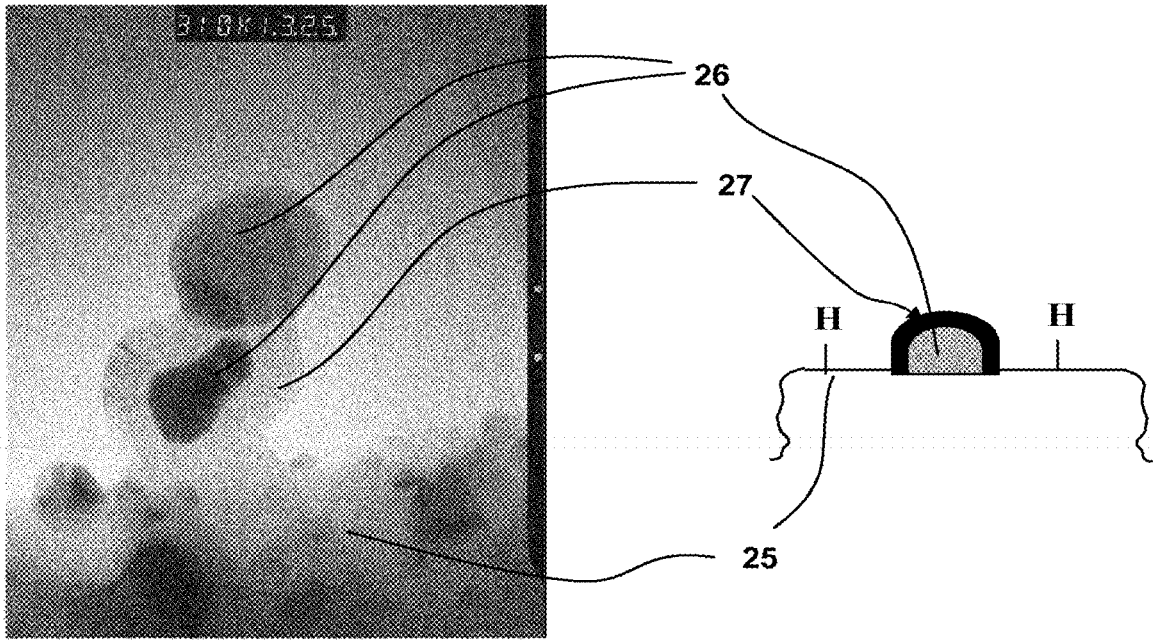
FIG. 11 is a TEM micrograph of a diamond particle decorated in cobalt metal particles together with a schematic diagram of the diamond surface.

FIG. 11 is a TEM micrograph of a diamond particle decorated in cobalt metal particles, 26, together with a schematic diagram of the diamond surface, 25. Each cobalt metal particle or grain, 26, is surrounded by a non-diamond carbon halo, 27 on a hydrogenated diamond surface, 25. The non-decorated portion of the diamond surfaces will be hydrogen terminated after such a heat treatment as The schematic diagram of FIG. 11 shows nano cobalt particles or grains decorating the surface of a diamond particle after reduction of cobalt carbonate decorant at 1050° C. for two hours in flowing 10% hydrogen/argon gas mixture. The hydrogen termination of the diamond surface where the metal decorant is absent is a useful feature of the some embodiments of the method when hydrogen heat treatment is included.

Insoluble hydroxides may also be precipitated and decorated onto diamond particle surfaces in suspension. For example nickel hydroxide, $Ni(OH)_2$, may be generated by the reaction of nickel nitrate solution with sodium hydroxide solution in water as indicated in equation (2) below.

$$Ni(NO_3)_2soln + 2NaOHsoln \xrightarrow[\text{suspension}]{H_2O\ \text{diamond}} Ni(OH)_2\downarrow + 2NaNO_3soln \quad (2)$$

The precipitative approach may also be applied to precursors which combine metals such as iron, nickel, cobalt, manganese, copper and the like as cations with the metals of the periodic table which may readily form stable carbides such as tungsten, molybdenum, chromium, tantalum, niobium, vanadium, zirconium, titanium and the like, as oxyanions.

These precursors may include tungstates, molybdates, chromates, tantalates, niobates, vanadates, zirconates and titanates. For example, cobalt tungstate $Co(WO_4)_2$ may be decorated onto diamond particle surfaces by the reaction of cobalt nitrate solution with sodium tungstate solution in water as indicated in equation (3).

$$Co(NO_3)_2soln + Na_2WO_4soln \xrightarrow[\text{suspension}]{H_2O\ \text{diamond}} CoWO_4\downarrow + 2NaNO_3soln \quad (3)$$

After reduction of the cobalt tungstate precursor, diamond decorated cobalt and tungsten carbide results where the atomic ratio of cobalt and tungsten is 50%. This chemical protocol may be combined with cobalt carbonate precipitation such that any cobalt to tungsten atomic ratio in the range 50 to close to 100% may be generated.

An alternative chemical protocol to introduce tungsten is to use the reaction of ammonium paratungstate $(NH_4)_{10}W_{12}O_{41}$ solution with dilute mineral acids such nitric acid, $HNO_3$ to precipitate tungstic oxide, $WO_3$ as surface decorant, which in turn is readily reduced in the presence of diamond to form tungsten carbide particles. Precipitation of carbonates after that of the tungstic oxide, such as cobalt carbonate using equation (1), may be done to co-decorate the diamond surfaces.

Figure 12:
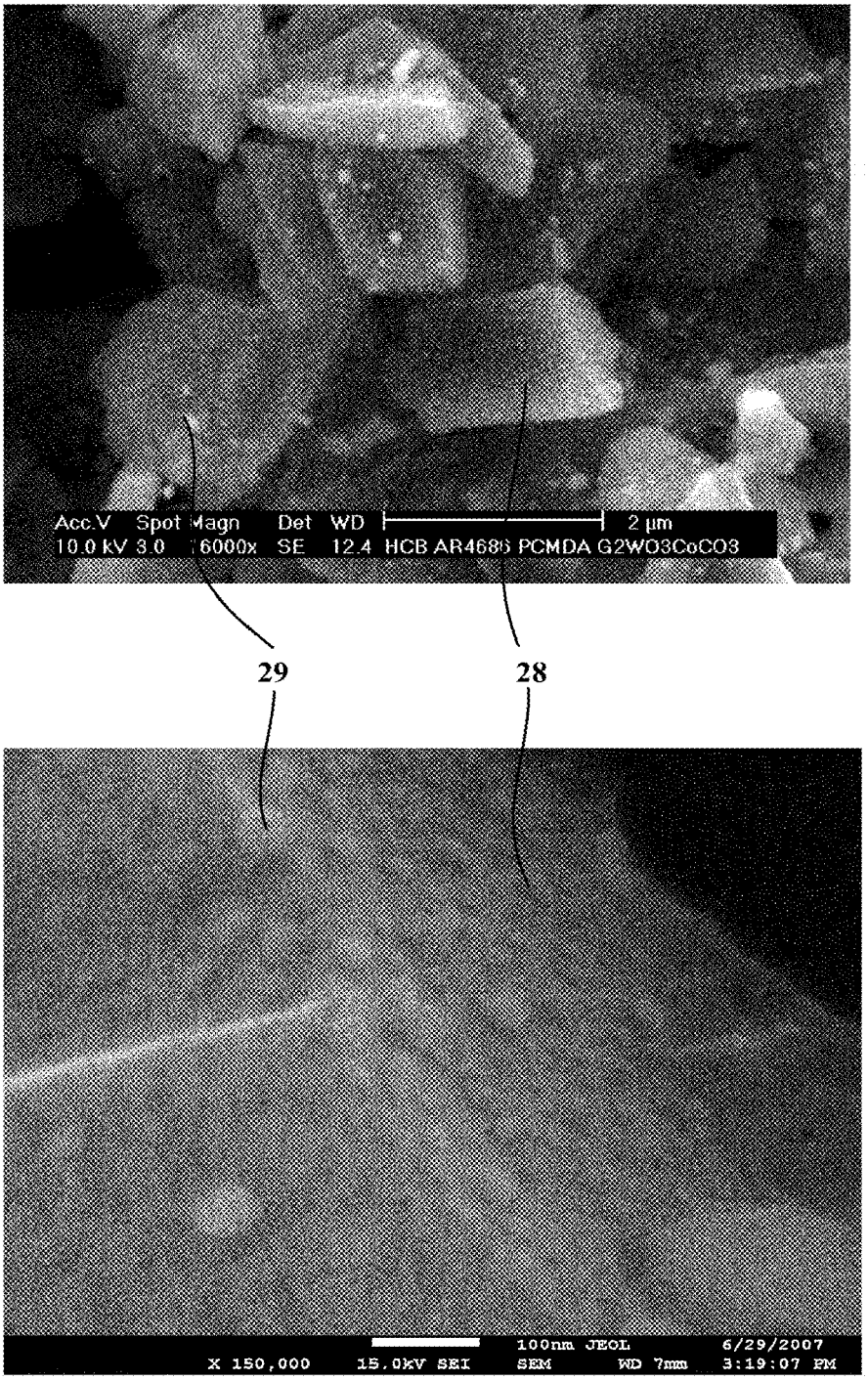
FIG. 12 is two SEM micrographs of diamond particles decorated in cobalt particles and tungsten carbide.

Two SEM micrographs are given in FIG. 12 showing the surface of diamond particles of about 2 micro meters in size, decorated in both cobalt, 28, and tungsten carbide, 29, particles after reduction of such a co-decoration in 10% hydrogen, argon flowing gas mixture at 1050° C. The precursor used for the cobalt was cobalt carbonate and the precursor used for the tungsten carbide was tungstic oxide. TEM microscopy also detected significant amounts of non-diamond, mainly amorphous carbon forming a covering on the cobalt particles after such furnace conditions. Very similar chemical protocols may be used to create decorants involving molybdenum carbides.

Where it is desired to generate decorants involving the carbides of the so called good carbide forming metallic elements such as, in particular, titanium, tantalum, niobium, vanadium, zirconium, chromium and the like a preferred chemical route is to react dry alcoholic solutions of the metal alkoxides with water, with the diamond powder suspended in alcohol. When this is done, amorphous, micro-porous coats of the metal oxide form on the diamond particles. On subsequent heat treatment these oxide coats form discrete decorations of metal carbide on the diamond particle surfaces. A general formula for the metal alkoxides is $M(OR)_n$, where n is dependent upon the valency of the metal M and R is a alkane group, such as methyl, —$CH_3$, ethyl, —$CH_2CH_3$, isopropyl, —$C_3H_7$ and the like. The metal alkoxides reaction with the water to yield hydroxides, as is given in equations (4), which then undergo polycondensation reactions to form the amorphous oxide coats as in equation (5).

$$M(OR)_n alc.soln + nH_2O \xrightarrow[\text{Suspension}]{C_2H_5OH\ \text{diamond}} M(OH)_n + nROH \quad (4)$$

$$_{n-1}(OH)M—OH + HO—M(OH)_{n-1} \xrightarrow[\text{Suspension}]{C_2H_5OH\ \text{diamond}} {}_{n-1}(HO)M—O—M(OH)_{n-1} + H_2O \quad (5)$$

An example reaction for amorphous tantalum oxide, $Ta_2O_5$ is given in equation (6) where tantalum ethoxide, $Ta(OC_2H_5)_5$ is reacted with water in ethyl alcohol, $C_2H_5OH$.

$$2Ta(OC_2H_5)alc.soln + 5H_2O \xrightarrow[\text{suspension}]{C_2H_5OH\ \text{diamond}} Ta_2O_5\downarrow + 10C_2H_5OH \quad (6)$$

After forming such micro-porous oxide coats, precursors for metals such as cobalt, nickel, iron, manganese and the like, such as carbonates or hydroxides, may be precipitated into and onto the oxide coats using the chemical reactions already indicated. Cermet or hard metal like compositions of combined decorations of these metals with carbides may then be formed by appropriate heat treatment in reducing environments.

Figure 13:
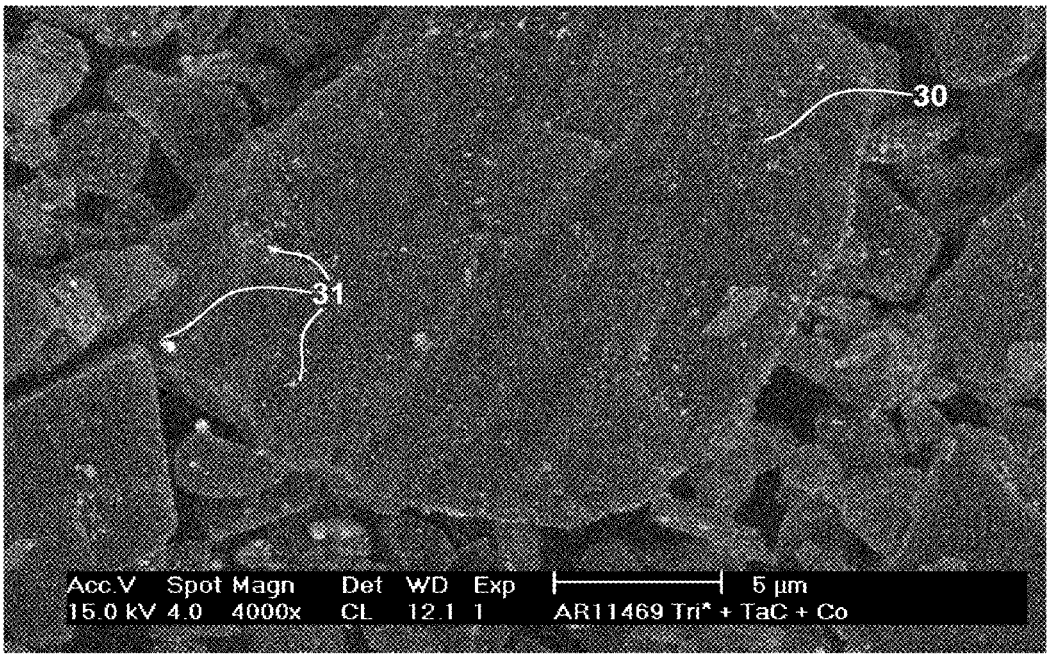
FIG. 13 is an SEM micrograph showing a multimodal size distribution of diamond particles which have been co-decorated in cobalt and tantalum carbide particles.

FIG. 13 shows an SEM micrograph of a multimodal diamond powder made up of fine diamond particles (about 2 micro meters in diameter) and coarser particles (from about 15 to 30 micro meters in diameter), which has been decorated in 5.3 weight % tantalum carbide (TaC) particles together with 3 weight % cobalt particles. The precursor for the TaC was amorphous $Ta_2O_5$ deposited onto the diamond surfaces by reaction (6). After settling, washing and drying procedures, the diamond powder was then co-decorated with cobalt carbonate crystals using the reaction of equation (1). Subsequently the combined precursors were reduced to form the TaC, cobalt metal co-decoration of FIG. 13 by heat treatment in flowing 5% hydrogen, nitrogen gas at 1100° C. for 3 hours. It may be seen in FIG. 13 that both the TaC particles 31 which appear bright in appearance and the cobalt metal particles 30 which appear duller in appearance are very much smaller than the diamond particles and homogeneously cover both the coarse and fine diamond particles.

Free standing PCD bodies may then be made from masses of diamond particles such as these, with their decorations of metal, metal carbide combinations. In such cases the resultant metal, metal carbide network of the PCD material may have cermet or hard metal carbide like compositions. Some embodiments of such compositions include WC/Co, TaC/Co and TiC/Ni.

Any of these chemical reactions to form the precursor compound decorants on the diamond particle surfaces may be done in sequence and applied to the pre-selected diamond powder as a whole or to any part or component of the diamond powder in appropriate suspension media.

The diamond powder components may be based upon mass fractions or upon size, size distribution or any desired combination of these. The part or component of the desired diamond size distribution is first suspended in the liquid medium and the chosen chemical reaction protocol(s) to decorate that component with chosen precursor(s) carried out. Subsequently, the remaining diamond powder component or part is added and suspended. The act of suspension and attendant vigorous stirring provides an efficient means of homogeneously mixing the decorated and undecorated portions of the diamond powder. In this way chosen pre-selected components of the diamond powder may be decorated in chosen metal with the other components remaining undecorated after subsequent dissociation/reduction of the precursor(s) to the metal(s).

Also, differing amounts of the same precursor may be decorated onto different mass and/or size fractions of the diamond powders by sequential adding of the components to the suspension, reaction vessel.

Alternatively, different amounts of and/or types of precursor(s) may be decorated on chosen diamond powder components in separated suspension vessels. Again a final combination of the suspensions can provide efficient homogeneous mixing of these components.

In addition, any of the diamond powder fractions or components may be made up of diamond particles differing in respect to diamond type. Diamond particles of differing type are distinguished here in regard to the variation in structure and/or quantity of lattice defects known in the art. In particular nitrogen related lattice defects are exemplary, which are known to affect the material properties of diamond. A convenient way to differentiate diamond type is to use natural diamond as opposed to standard synthetic diamond, natural diamond having typically aggregated nitrogen lattice defects as compared to standard synthetic diamond which contains single atoms of nitrogen substituting for carbon atoms at levels typically of about 100 ppm.

These means of associating different amounts and/or different metal compositions with different diamond fractions or components may provide a highly accurate and versatile way of manipulating the diamond sintering mechanisms at the local scale of the diamond particles and in turn engendering manipulation of structure and composition at such a scale. For example, if certain fractions remain free of metal during initial application of load and heat in the high pressure apparatus, diamond particle, point to surface contact for the particles of such fractions can be un-fettered by metal decoration leading to enhanced plastic deformation of such particles. This in turn may be possible to facilitate local enhanced diamond to diamond bonding. Further it may be possible to associate immovable "unmelted" particles with some diamond particle fractions and not others. For example metal carbide particles such as tungsten carbide, titanium carbide, tantalum carbide and the like may be decorated onto and associated only with a particular size fraction of the diamond. A vast number of PCD free standing body embodiments with novel compositions, structures and properties may in this way be generated using such prepared decorated diamond powder, metal combinations or masses.

The homogeneous mass of diamond and metal is consolidated to form a so-called "green body" of desired size and 3-dimensional shape. Means of forming a green body include simple die set compaction, isostatic compaction, gel casting, injection moulding and the like and any other technique or procedure known in the art. Where isostatic compaction is used, hot isostatic procedures are preferred due to superior strength of the green bodies occurring. Preferences amongst such means to produce green bodies may be determined by the degree to which each technique can maintain general compositional and special homogeneity. Temporary organic binders such as methyl cellulose, polyvinyl alcohol, polyvinyl bitherol and the like may be employed to aid with green body integrity and of sufficient strength for practical handling.

The homogeneous green body is then encapsulated such that it may be contained and isolated from the pressure and temperature media and structures of high pressure and high temperature cells, capsules or reaction chambers as well known in the art of polycrystalline diamond manufacture. Where the 3-dimensional shape of the desired PCD body is geometrically simple canisters made from refractory metals may be used. Where general convex 3-dimensional shapes of the PCD body are desired, appropriate canisters may be moulded from refractory metals. The encapsulation material or metal canisters are preferably organised so that they may be evacuated and sealed again as had been established and is well known in the art. Removing atmospheric gases from the porosities of the green body and sealing the green body's encapsulation materials to maintain a vacuum in the porosities is a preference. Prior to the sealing of the encapsulation materials or canisters or temporary organic binders which may have been employed in forming the green bodies must be removed by procedures such as heat treatment and the like.

The green bodies in their sealed encapsulations are then assembled into a cell or capsule comprising pressure and temperature transmitting media and heating element structures as known in the art. The design of the cell or capsule is chosen so that pressure and temperature gradients experienced by the green body at its sintering conditions are minimised. Low shear strength pressure transmitting materials such as ionic salts often combined with ceramic powders may be used, for example, sodium chloride combined with zirconia, $ZrO_2$. These measures assist in enabling the homogeneity of the structure and composition of the green body to be translated into corresponding homogeneity of the PCD body on sintering. Moreover, in this regard, the pressure and temperature time cycle may be chosen so that simultaneous and or symmetrical melting of the metal component in the green body occurs.

A further precaution to engender stress free and crack free standing PCD bodies may be to release the pressure during the end phase of the manufacturing cycle with the maintenance of sufficient temperature to maintain the pressure transmitting media of the cell or capsule in as plastic a state as possible. The homogeneity of the green body together with the precautions outlined above is necessary so that the shrinkage during sintering of the diamond particles is equal in all orthogonal directions. In this way, the pre-selected 3-dimensional shape of the green body may be maintained and translated to the final free standing PCD body. In addition, the degree and magnitude of the equi-directional shrinkage for each variant or embodiment of PCD material and body may be empirically determined. Some of the embodiments of the methods described herein thus may allow free standing, macro stress free PCD bodies of net or near net size and shape to be generated.

This feature of net or near net size and shape may provide practical and commercial viability and attractiveness as further sizing and shaping is minimized or not required.

The green bodies generated by the above methods are subjected to high pressure, high temperature conditions for appropriate times to cause sintering of the diamond particles and form the free standing PCD bodies. Each specific chosen metallic composition may require specific temperature, pressure and time cycles to be determined empirically such that the re-crystallized diamond is of good quality crystal and is largely defect free. Typical pressure and temperature conditions are in the range of 5 to 15 GPa and in the range of 1200 to 2500° C. respectively. Preferably pressures in the range 5.5 to 8.0 GPa along with temperatures in the range 1350 to 2200° C. are used.

Some embodiments are described in more detail below with reference to the examples, which are not intended to be limiting.

EXAMPLES

Example 1

PCD free standing, macro residual stress free, bodies each comprising an intergrown diamond network with a monomodal, mean grain size of close to 1 micro meter with an inter-penetrating metallic network made up of independently pre-selected alloy made up of 95 weight % cobalt and 5 weight % nickel were manufactured. The overall diamond content was pre-selected independently of the diamond size distribution and alloy composition to be about 93 volume % with the metal being a corresponding 7 volume %. The PCD body was a right cylinder 13 mm in diameter and 8 mm long. The method as outlined in FIG. 5 column 2 was used whereby the precursor for the metallic component of the PCD body was reactively created in a water liquid suspension of starting diamond particles and was caused to nucleate and grow on the surfaces of the starting diamond particles. The following sequential steps and procedures were carried out in order to so manufacture this PCD free standing body.

a) A mass of combined diamond particles and metallic materials was created in the following manner.

100 g of monomodal diamond powder of mean particle size of about 1 micro meter, extending from about 0.75 to 1.25 micro meters, was suspended in 2.5 litres of de-ionised water. The size distribution had only one maximum at the average particle size of 1 micro meter. This type of size distribution had been designated as monomodal. The diamond powder had previously been produced by crushing and classifying procedures known in the art, the source material for which was conventional, commercial synthetic type Ib diamond abrasive. The diamond powder had also been previously heated in a mixture of sulphuric acid and nitric acid which after washing in de-ionised water ensured that the powder was now hydrophilic with a surface chemistry dominated by oxygen molecular species such as —OH, —C—O—C—, —C═O and the like.

To the suspension a mixed aqueous solution of cobalt and nickel nitrate and an aqueous solution of sodium carbonate were slowly and simultaneously added while the suspension was vigorously stirred. Equation (7) below was used to calculate the required amounts of cobalt and nickel nitrates.

$$0.95Co(NO_3)_2+0.05Ni(NO_3)_2+Na_2CO_3=Co_{0.95}Ni_{0.05}CO_3+2NaNO_3 \quad (7)$$

The mixed cobalt and nickel nitrate aqueous solution was made by dissolving 89.25 g of cobalt nitrate hexahydrate, $Co(NO_3)_2.6H_2O$, crystals and 4.71 g of nickel nitrate hexahydrate, $Ni(NO_3)_2.6H_2O$, crystals in 200 ml of de-ionised water. In this way the atomic ratio of cobalt:nickel was 95:5. The sodium carbonate aqueous solution was made by dissolving 35 g of sodium carbonate, $Na_2CO_3$, in 200 ml of de-ionised water. The mixed cobalt, nickel nitrate and sodium carbonate reacted to form mixed cobalt nickel carbonate precipitate crystals.

The mixed cobalt nickel carbonate precursor, nucleated and grew on the diamond particle surfaces and formed a discrete set of particles decorating the surfaces. The sodium nitrate product of the reaction, equation 7, being highly soluble in water was then removed by a few repeated cycles of decantation and washing in de-ionised water. After a final wash in pure ethyl alcohol the precursor decorated diamond powder was dried under vacuum at 60° C.

The dried powder was then placed in an alumina ceramic boat with a loose powder depth of about 5 mm and heated in a flowing stream of argon gas containing 5% hydrogen. The top temperature of the furnace was 1050° C. which was maintained for 2 hours before cooling to room temperature. This furnace treatment dissociated and reduced the mixed cobalt-nickel carbonate to form alloy particles decorating the surfaces of the diamond particles. In this way it was ensured that the alloy metal particles were always smaller than the diamond particles with the alloy being homogeneously distributed.

Figure 15:
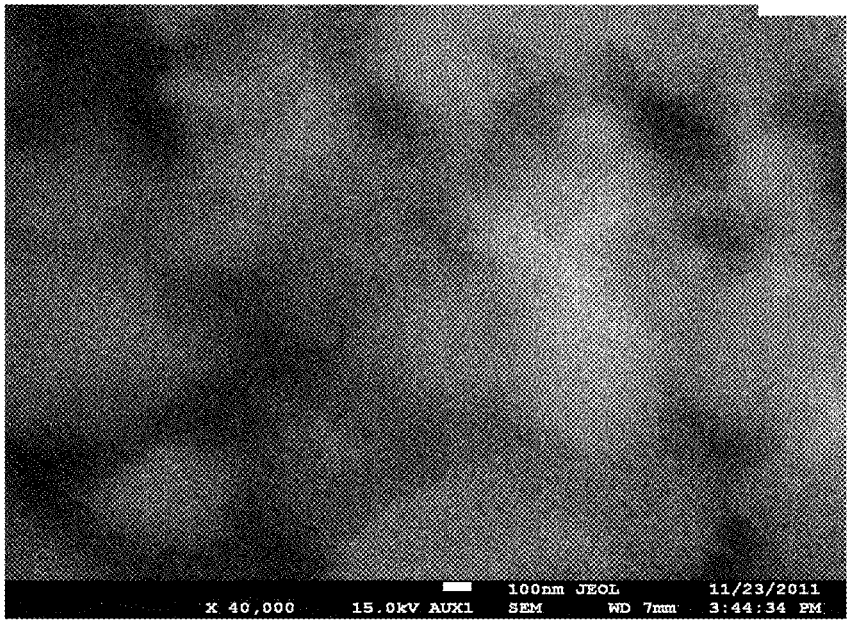
FIG. 15 is an SEM micrograph of mixed cobalt nickel carbonate crystals decorating 1 micron diamond particles.

FIG. 15 is an SEM micrograph showing the fine cobalt nickel carbonate crystals decorating the 1 micron diamond particle surfaces. It may be seen that the precursor crystals or particles are all significantly smaller than the diamond particles.

Figure 16:
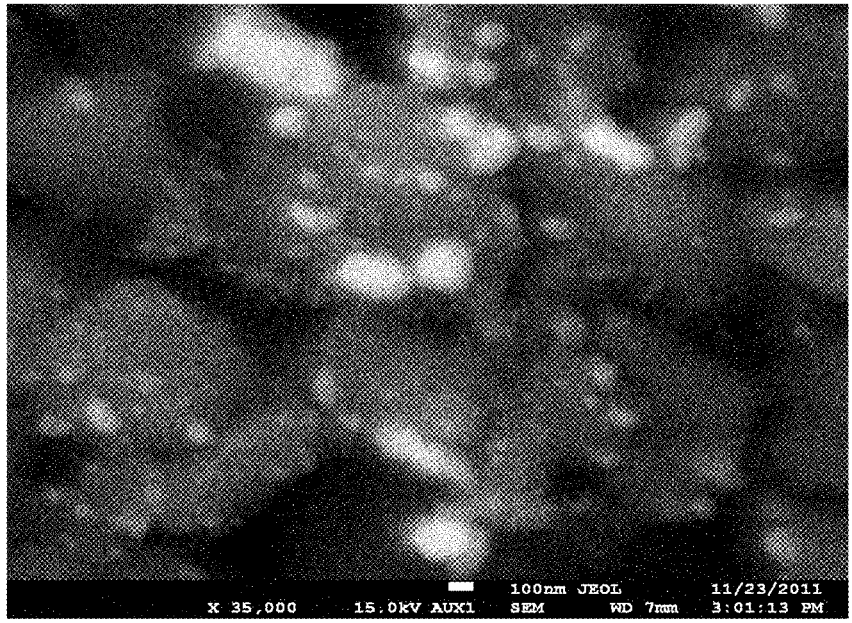
FIG. 16 is an SEM micrograph showing 95% cobalt, 5% nickel alloy metal particles decorating the surfaces of 1 micron diamond particles.

FIG. 16 is an SEM micrograph showing the alloy metal particles decorating the diamond particle surfaces. The alloy metal particles comprise 95% cobalt, 5% nickel alloy metal particles which are shown as decorating the surfaces of 1 micron diamond particles. The conditions of the heat treatment also caused amorphous non-diamond carbon to form at the surfaces of the cobalt-nickel alloy particles. The resultant powder mass had a black appearance. The powder mass was stored under dry nitrogen in an air-tight container.

b) 4.4 g fractions of the diamond-metal powder mass were then pre-compacted into a niobium cylindrical canister using a uni-axial hard metal compaction die. A second niobium cylindrical canister of slightly larger diameter was then slid over the first canister in order to surround and contain the pre-compacted powder mass. The free air in the porosities of the pre-compacts was then evacuated and the canisters sealed under vacuum using an electron beam welding system known in the art. The canister assemblies were then subjected to cold isostatic compaction at a pressure of 200 MPa to consolidate to a high green density and to eliminate spatial density variations. In this way homogeneous green bodies were produced with measured densities of about 2.7 $g \cdot cm^{-3}$, which corresponds to a porosity of approximately 35% by volume.

c) Each encapsulated cylindrical green body was then placed in an assembly of compactable ceramic, salt components suitable for high pressure high temperature treatment as well established in the art. The material immediately surrounding the encapsulated green body was made from very low shear strength material such as sodium chloride. This provides for the green bodies being subjected to pressures which approach a hydrostatic condition. In this way pressure gradient induced distortions of the green body may be mitigated.

The green bodies were subjected to a pressure of 7.5 GPa and a temperature of approximately 1950° C. for 1 hour using a belt type high pressure apparatus as well established in the art. During the end phase of the high pressure high temperature procedure the temperature was slowly reduced over several minutes to approximately 750° C., maintained at this value and then the pressure was reduced to ambient conditions. The high pressure assembly was then allowed to cool to ambient conditions before extraction from the high pressure apparatus. This procedure during the end phase of the high pressure high temperature treatment was thought to allow the surrounding salt media to remain in a plastic state during the removal of pressure and so prevent or inhibit shear forces bearing upon the now sintered PCD body. The final dimensions of the free standing PCD cylindrical body were then measured and the shrinkage calculated.

d) SEM image analysis was undertaken on sectioned and polished samples of the PCD bodies. These showed a well sintered continuous network of diamond and an interpenetrating network of metal. There was an absence of other material phases such as oxides and carbides. In order to assess the homogeneity of the microstructure, SEM image fields of at least 10 times by 10 times the average grain size for sections and polished samples taken in both axial and diametral directions were considered and compared. For this specific example, where the average grain size was close to 1 micro meter, ten micro meters by ten micro meters image fields were compared from place to place on the polished cross-sections. The magnification employed was ×10,000. Across the axial section, 9 fields were chosen to be representative of the centre and the edge positions. In addition, across the diametral section a further 5 centre to edge positions were compared. In terms of the image contrast and geometric pattern of the diamond grains and metal pool, no difference could be seen. No grains greater than 3 micro meters were found. It was therefore concluded that the PCD material microstructure was invariant from image to image showing that the material was homogeneous above this scale, i.e., above the scale of 10 times the average grain size, in this particular case above the 10 micro meter scale. As explained in the previous sections, since this specific example was made from one composition of PCD material, then it implies that the free standing PCD body was macroscopically stress free above this scale.

To check this, a biaxial strain gauge was attached to one face of a PCD cylinder and the cylinder cut in half midway along its axis using electro discharge machining (EDM). It was noted that no change of strain was observed. If the PCD free standing body had a macroscopic residual stress distribution across its dimension, then removing half of the body would inevitably have resulted in a strain response. Since no strain response was observed it was concluded and confirmed that the free standing body was macroscopically stress free.

A finite element method was used in order to numerically assess the micro residual stress magnitude for this composition of PCD material. The elastic modulus assumed in the calculations for diamond and the 95% Co-5% Ni alloy were 1050 and 200 GPa, respectively. The difference in linear thermal expansion coefficient was 11 ppm ° $K^{-1}$. The linear thermal expansion coefficient for this alloy falls within the range 10 to 14 ppm ° $K^{-1}$. The micro residual stress for this particular PCD material would therefore be considered by the previous definitions to be in the "high" category. The calculated micro residual principal tensile stress magnitude in the metallic network using the Finite Element analysis with its attendant assumptions was 2300 MPa which was consistent with the micro residual stress being considered as high.

Example 2

PCD free standing, macro residual stress free, bodies each comprising an intergrown multimodal diamond network where the grain size distribution extends from about 2 micro meters to about 30 micro meters with a mean grain size of close to 10 micro meter together with an inter-penetrating metallic network made up of pure cobalt were manufactured. The overall diamond content was pre-selected independently of the diamond size distribution and metal composition to be about 91 volume % with the metal being a corresponding 9 volume %. The PCD body was a right cylinder 16 mm in diameter and 16 mm long. The method outlined in FIG. 5 column 2 was used whereby the precursor for the metallic component of the PCD body was reactively created in a water liquid suspension of starting diamond particles and was caused to nucleate and grow on the surfaces of the starting diamond particles. The following sequential steps and procedures were carried out in order to so manufacture this PCD free standing body.

a) A mass of combined diamond particles and metallic materials was created in the following manner.

100 g of diamond powder was suspended in 2.5 litres of de-ionised water. The diamond powder comprised 5 separate so-called monomodal diamond fractions each differing in average particle size. The diamond powder was thus considered to be multimodal. The 100 g of diamond powder was made up as follows: 5 g of average particle size 1.8 micro meters, 16 g of average particle size 3.5 micro meters, 7 g of average particle size 5 micro meters, 44 g of average particle size 10 micro meters and 28 g of average particle size 20 micro meters. This multimodal particle size distribution extended from about 1 micro meter to about 30 micro meters.

The diamond powder had been rendered hydrophilic by prior acid cleaning and washing in de-ionised water. To the suspension an aqueous solution of cobalt nitrate and a separate aqueous solution of sodium carbonate were simultaneously slowly added while the suspension was vigorously stirred. The cobalt nitrate solution was made by dissolving 123.5 grams of cobalt nitrate hexahydrate crystals, $Co(NO_3)_2.6H_2O$, in 200 ml of de-ionised water. The sodium carbonate solution is made by dissolving 45 g of pure anhydrous sodium carbonate, $Na_2CO_3$ in 200 ml of de-ionised water. The cobalt nitrate and sodium carbonate reacted in solution as per equation (1), in the presence of the suspended diamond powder and cobalt carbonate crystals nucleated and grew on the diamond particle surfaces. The cobalt carbonate precursor compound for cobalt, took the form of whisker shaped crystals decorating the diamond particle surfaces identical in form to those shown in FIGS. 9*a* and *b*. The sodium nitrate product of reaction was removed by a few cycles of decantation and washing in de-ionised water. The powder was finally washed in pure ethyl alcohol, removed from the alcohol by decantation and dried under vacuum at 60° C.

The dried powder was then placed in an alumina ceramic boat with a loose powder depth of about 5 mm and heated in a flowing stream of argon gas containing 5% hydrogen. The top temperature of the furnace was 700° C. which was maintained for 2 hours before cooling to room temperature. This furnace treatment dissociated and reduced the cobalt carbonate precursor to form pure cobalt particles decorating the surfaces of the diamond particles. In this way it was ensured that the cobalt particles were always smaller than the diamond particles with the cobalt being homogeneously distributed. The conditions of the heat treatment were chosen with reference to the cobalt carbon phase diagram of FIG. 7. At 700° C. it may be seen that the solid solubility of carbon in cobalt is low. Thus the formation of amorphous non-diamond carbon at this temperature is very low and no non-diamond carbon could be detected in the final diamond-metal particulate mass. The resultant powder mass had a pale light grey appearance. The powder mass was stored under dry nitrogen in an air-tight container.

b) 13.4 g fractions of the diamond-metal powder mass were then pre-compacted into a niobium cylindrical canister using a uni-axial hard metal compaction die. Right cylindrical green bodies with homogeneous porosity distribution, encapsulated and vacuum sealed in niobium canisters were then produced using the procedures specified in Example 1. The diameter and length of each encapsulated green body cylinder were measured and the diameter and length of each cylindrical green body itself calculated using knowledge of the wall thicknesses of the canisters. Both the average diameter and length of the green body cylinders were calculated to be 18.25 mm.

c) Each of the encapsulated green bodies was then subjected to high pressure and high temperature conditions in order to cause diamond particle to particle bonding via partial diamond recrystallisation. The procedures specified in Example 1 were used except that the pressure and temperature conditions were significantly lower, specifically 5.6 GPa and 1400° C. Again, the temperature during the return to room pressure at the end stage of the manufacturing cycle was maintained close to about 750° C. This precaution was intended to mitigate any possible shear stresses being applied during the end stage of the cycle.

d) SEM image analysis was undertaken on sectioned and polished samples of the PCD bodies. These showed a well sintered continuous network of diamond and an interpenetrating network of metal. There was an absence of other material phases such oxides and carbides. Hundred micro meters by hundred micro meters image fields were compared from place to place on the polished cross-sections. It was found that the PCD material microstructure was invariant from image to image showing that the material was homogeneous above this scale. This implies that the free standing PCD body is macroscopically stress free above this scale.

A finite element method was used in order to numerically assess the micro residual stress magnitude for this composition of PCD material. The elastic modulus assumed in the calculations for diamond and the Co metallic network was 1050 and 200 GPa, respectively. The linear coefficient of thermal expansion for cobalt is 13 ppm ° $K^{-1}$, which falls in the range of 10 to 14 ppm ° $K^{-1}$. The calculated micro residual principal tensile stress magnitude in the metallic network using the Finite Element analysis with its attendant assumptions was in excess of 2000 MPa which was consistent with the micro residual stress being considered as high.

The dimensions of each final cylindrical PCD free standing body were measured at various positions along the length of the cylinders and the squareness was checked. It was evident that only minimal geometric distortion had occurred indicating the achievement of near net shape. The average shrinkage of both diameter and length due to the sintering of the material was 12%. Knowledge of this shrinkage factor for this particular PCD material allows the final dimension to be pre-selected, thus making near net sizing possible.

Example 3

PCD free standing, macro residual stress free, bodies each comprising an intergrown diamond network where the grain size distribution extends from about 2 micro meters to about 30 micro meters, with a mean grain size of close to 10 micro meter together with an inter-penetrating metallic network made up of pure cobalt were manufactured. The overall diamond content was pre-selected independently of the diamond size distribution and metal composition to be about 95 volume % with the metal being a corresponding 5 volume %. The preparation method in this example was changed compared to that of Example 2 with the intention of creating favourable micro structural consequences related to degree of intergrowth and contiguity of the diamond grains. The basis of the change of preparation method was that the precursor compound for the metal component of the PCD was decorated onto a pre-selected portion of the diamond powder. In this example, the pre-selected portion upon which all of the metal was decorated was made up of the three coarsest size fractions which also correspond to about half of the total diamond particle surface area.

a) A mass of combined diamond particles and metallic materials was created in the following manner.

Two portions of diamond powder were used totaling 100 g. One portion of 79 g of diamond powder made up of 7 g of average particle size 5 micro meters, 44 g of average particle size 10 micro meters and 28 g of average particle size 20 micro meters was suspended in 2.5 litres of de-ionised water. This portion of the diamond powder comprised 3 separate so-called monomodal diamond fractions each differing in average particle size. The diamond particle surface area of this portion of the diamond powder corresponded to approximately 50% of the total surface area of all the powder. The remaining portion of total mass 21 g of diamond powder made up of 5 g of average particle size 1.8 micro meters and 16 g of average particle size 3.5 micro meters was retained. To the suspension an aqueous solution of cobalt nitrate and a separate aqueous solution of sodium carbonate were simultaneously slowly added while the suspension was vigorously stirred. The cobalt nitrate solution was made by dissolving 65.7 g of cobalt nitrate hexahydrate crystals, $Co(NO_3)_2.6H_2O$, in 200 ml of de-ionised water. The sodium carbonate solution was made by dissolving 24 g of pure anhydrous sodium carbonate, $Na_2CO_3$ in 200 ml of de-ionised water. It was assumed that the cobalt nitrate and sodium carbonate reacted in solution as per equation (1). In the presence of the suspended diamond powder, cobalt carbonate crystals nucleated and grew on the diamond particle surfaces. While continuing the stirring of this suspension, the remaining 21 g portion of diamond powder was added. Since the reaction generating the cobalt carbonate precursor was complete prior to this addition, this fine sized diamond powder portion remained un-decorated. Incorporating this portion in suspension served to homogeneously mix the two portions of diamond powder. A dry particulate mass of powder was then made using the washing and drying procedures of Example 2.

b) Free standing PCD bodies were then made using this mass of combined diamond and cobalt using the green body consolidation and high pressure high temperature sintering procedures as described in Example 2.

c) SEM image analysis procedures were carried out on sectioned and polished samples. It was concluded that excellent diamond grain contiguity with good general homogeneity had resulted.

Example 4

PCD free standing, macro residual stress free, bodies were made with the same diamond composition and size distribution as in Example 2. The metal was pre-selected independently to be 9 volume percent pure Nickel. As in Example 2, the method as outlined in FIG. 5 column 2 was used. The following sequential steps and procedures were carried out in order to so manufacture this PCD free standing body, differing from Example 2 in that the precursor compound was a hydroxide as opposed to a carbonate.

a) A 100 g of diamond powder identical to that used in Example 2 was suspended in 2.5 litres of de-ionised water. While continuously stirring the suspension, an aqueous solution of nickel nitrate was slowly added. Simultaneously an aqueous solution of sodium hydroxide was slowly added. The nickel nitrate solution was made by adding 96.8 g of nickel nitrate hexahydrate, $Ni(NO_3)_2.6H_2O$, to 200 ml of de-ionised water. The sodium hydroxide solution was made by adding 27 g of pure sodium hydroxide crystals, NaOH, to 200 ml of de-ionised water. Insoluble nickel hydroxide, $Ni(OH)_2$, was precipitated as per equation (2), and decorated the surfaces of the diamond particles. In this case nickel hydroxide was the precursor compound for nickel metal. A dry mass of the diamond powder decorated in the nickel hydroxide was then obtained by a few cycles of settling, washing in pure water and drying under vacuum at 60° C. The mass of diamond powder decorated in nickel hydroxide was then heated in a vacuum furnace at a top temperature of 800° C. for 1 hour. The nickel hydroxide was converted into nickel metal which decorated the diamond particle surfaces. The solid solubility of carbon in nickel at 800° C. is low and very little non-diamond amorphous carbon was formed. The resulting mass had a grey appearance.

b) Right cylindrical green bodies were then made using the same procedures as given in Example 2.

c) Each of the encapsulated green bodies was then subjected to high pressure and high temperature conditions in order to cause diamond particle to particle bonding via partial diamond recrystallisation. The pressure, temperature, time cycle was identical to that of Example 2.

d) SEM image analysis was carried out and showed a well sintered continuous network of diamond, with homogeneity of diamond and nickel. There was an absence of other material phases such oxides and carbides, in particular, indicating the presence of only pure nickel metal. The SEM images showing fields of about 100× 120 micro meters taken from various parts of polished cross sections were identical in regard to the distribution of diamond and metal. This indicated that above this scale, the material was homogeneous and could be considered to be macroscopically stress free.

Example 5

PCD free standing, macro residual stress free, bodies were made with the same diamond composition and size distribution as in Examples 2 and 4. The metal was pre-selected independently to be 9 volume percent of a iron, 33 weight percent nickel alloy. As in Examples 2 and 4, the method as outlined in FIG. 5 column 2 was used. The following sequential steps and procedures were carried out in order to so manufacture this PCD free standing body. The precursor compound was a mixed ferrous, nickel carbonate.

a) A 100 g of diamond powder identical to that used in Examples 2 and 4 was suspended in 2.5 litres of de-ionised water. While continuously stirring the suspension, an aqueous mixed solution of ferrous nitrate and nickel nitrate was slowly added. Simultaneously an aqueous solution of sodium carbonate was slowly added. The mixed ferrous nitrate, nickel nitrate solution was made by adding 79.4 g of ferrous nitrate hexahydrate crystals, $Fe(NO_3)_2.6H_2O$, and 37.6 g of nickel nitrate hexahydrate, $Ni(NO_3)_2.6H_2O$, to 200 ml of de-ionised water. The sodium carbonate solution was made by adding 44 g of pure anhydrous sodium carbonate, $Na_2CO_3$, to 200 ml of de-ionised water. A mixed ferrous iron, nickel carbonate, of nominal formula $Fe_{0.67}Ni_{0.33}CO_3$ was precipitated and decorated the diamond particle surfaces. A dry particulate mass of diamond decorated in this alloy precursor was then produced by several cycles of settling decantation and washing in pure water followed by drying under vacuum at 60° C. The mass of diamond powder decorated in the mixed carbonate was then heated in a vacuum furnace at a top temperature of 850° C. for 1 hour. The mixed carbonate was converted into an iron nickel alloy which decorated the diamond particle surfaces. A small sample of resulting particulate mass was taken and dissolved in nitric acid in order that chemical analysis techniques such as inductively coupled plasma spectroscopy (ICP) could be applied to determine and confirm the alloy composition. The alloy was shown to be iron, 33% nickel and therefore accurately as pre-selected.

b) Right cylindrical green bodies were then made using the same procedures as given in Example 2.

c) Each of the encapsulated green bodies was then subjected to high pressure and high temperature conditions in order to cause diamond particle to particle bonding via partial diamond recrystallisation. The pressure, temperature, time cycle was identical to that of Example 2 and 4.

d) SEM image analysis was carried out and showed a well sintered continuous network of diamond, with homogeneity of diamond and metal alloy. There was an absence of other material phases such oxides and carbides, in particular, indicating the presence of only iron nickel alloy metal. The SEM images showing fields of about 100×120 micro meters taken from various parts of polished cross sections were identical in regard to the distribution of diamond and metal. This indicated that above this scale, the material was homogeneous and could be considered to be macroscopically stress free.

A finite element method was used in order to numerically assess the micro residual stress magnitude for this composition of PCD material. It is known from the literature (ref. 4) that iron 33% nickel with 0.6% carbon in solid solution is a low thermal expansion alloy which exhibits a linear coefficient of thermal expansion of 3.3 ppm $^\circ K^{-1}$ at and near room temperature which falls within the range of less than 5 ppm $^\circ K^{-1}$. The difference in thermal expansion coefficient between diamond and this alloy was therefore small. The literature elastic modulus for this alloy is about 150 GPa. However, the difference in elastic modulus between diamond and this alloy remains high and is typical of transition alloys. During the pressure and temperature release, at the end of the manufacturing cycle, it would therefore be expected that the residual stress would predominantly originate from the differential expansion of the metal relative to diamond on pressure release. The micro residual stress in the metal would then be compressive in nature. The calculated micro residual principal compressive stress magnitude in the metallic network using the Finite Element analysis with its attendant assumptions was in excess of −2000 MPa. This Finite Element analysis clearly indicates that using certain accurately produced low expansion alloys that the micro residual stress can be compressive. This is an aspect of the present invention.

Example 6

PCD free standing, macro residual stress free, bodies were made with the same diamond composition and size distribution as in Examples 2, 4 and 5. The metallic network was pre-selected independently to be 9 volume percent of the PCD, and to be a cobalt, tungsten carbide cermet. This cermet itself was pre-selected to be made up of 78 volume percent cobalt and 22 volume percent tungsten carbide (66.8 weight percent cobalt, 33.2 weight percent tungsten carbide).

As in Examples 2, 4 and 5, the method as outlined in FIG. 5 column 2 was used. The following sequential steps and procedures were carried out in order to so manufacture this PCD free standing body. The precursor compounds used were cobalt carbonate and tungstic oxide, $WO_3$.

a) 100 g of diamond powder identical to that used in Examples 2, 4 and 5 was suspended in 2.5 litres of de-ionised water. While continuously stirring the suspension, an aqueous solution of cobalt nitrate was slowly added. Simultaneously an aqueous solution of sodium carbonate was slowly added. Cobalt carbonate was precipitated and decorated the diamond particle surfaces. While maintaining this decorated diamond powder in suspension, an aqueous solution of ammonium paratungstate was slowly added. Simultaneously, dilute nitric acid was added. Tungstic oxide, $WO_3$, was precipitated and decorated the diamond particle surfaces. In this way, the diamond surfaces were co-decorated in both cobalt carbonate and tungstic oxide. The cobalt nitrate solution was made by adding 96.3 g of cobalt nitrate hexahydrate crystals, $Co(NO_3)_2.6H_2O$ to 200 ml of de-ionised water. The sodium carbonate solution was made by adding 35.5 g of pure anhydrous sodium carbonate, $Na_2CO_3$, to 200 ml of de-ionised water. The ammonium paratungstate solution was made by adding 12.9 g of ammonium paratungstate pentahydrate, $(NH_4)_{10}(W_{12}O_{41}).5H_2O$ to 200 ml of de-ionised water. The dilute nitric acid solution was made by adding AR grade concentrated nitric acid to 200 ml of de-ionised water to provide a concentration of 0.25 mols per litre. The particulate diamond mass was then washed free of the sodium and ammonium nitrate by-product of the reaction and any un-reacted soluble material by several cycles of settling, addition of pure de-ionised water and decantation. Finally, the diamond particulate mass, co-decorated in cobalt carbonate and tungstic oxide was dried under vacuum at 60° C. The dried powder was then placed in an alumina ceramic boat with a loose powder depth of about 5 mm and heated in a flowing stream of argon gas containing 5% hydrogen. The top temperature of the furnace was 1000° C. which was maintained for 2 hours before cooling to room temperature. This furnace treatment dissociated and reduced the cobalt carbonate precursor to form pure cobalt particles. The tungstic oxide precursor was reduced and the resultant tungsten reacted with some of the diamond present to form tungsten carbide. The surfaces of the diamond particles were in this way now co-decorated in cobalt and tungsten carbide particles. These particles were always smaller than the diamond particles and extremely well and homogeneously distributed.

A sample of the particulate mass was heat treated in acid to dissolve the metallic component and ICP chemical analysis carried out. The atomic ratio of cobalt to tungsten was found to be approximately 68% Co, 32% W which is consistent with the pre-selected choice of cermet composition, namely, 78 volume percent cobalt and 22 volume percent tungsten carbide.

b) Right cylindrical green bodies were then made using the same procedures as given in Example 2.

c) Each of the encapsulated green bodies was then subjected to high pressure and high temperature conditions in order to cause diamond particle to particle bonding via partial diamond recrystallisation. The procedures specified in Example 1 were used except that the pressure and temperature conditions were significantly lower, specifically 5.6 GPa and 1400° C. as used in Example 2. Again, the temperature during the return to room pressure at the end stage of the manufacturing cycle was maintained close to about 750° C. This precaution was intended to mitigate any possible shear stresses being applied during the end stage of the cycle.

d) SEM image analysis was carried out and showed a well sintered continuous network of diamond, with an interpenetrating cermet network comprising fine tungsten carbide grains bonded with cobalt. There was an absence of other material phases such oxides. The SEM images showing fields of about 100×120 micro meters taken from various parts of polished cross sections were identical in regard to the distribution of diamond and cermet network. This indicated that above this scale, the material was homogeneous and could be considered to be macroscopically stress free.

A finite element method was used in order to numerically assess the micro residual stress magnitude for this composition of PCD material. The linear coefficient of thermal expansion for the particular cermet network (66.8 weight percent cobalt, 33.2 weight percent carbide) produced was estimated from the literature values for cobalt and tungsten carbide to be 10.6 ppm ° $K^{-1}$. This falls within the range of 10 to 14 ppm ° $K^{-1}$. Similarly, the modulus of elasticity was estimated to be 360 GPa. The calculated micro residual tensile stress magnitude in the metallic/cermet network was in the range 1800 to 2200 MPa which is considered to be in the high range as expected for this composition of PCD material but, nevertheless, clearly less than the magnitude calculated for the cobalt case of Example 2.

Example 7

PCD free standing bodies each comprising an intergrown diamond network and an interpenetrating metallic network were made using a starting diamond powder with an average particle size of 0.5 micro meters. The metallic network was pre-selected to be 11 volume percent of the PCD material with the metal independently pre-selected to be a 50% by weight nickel, 50% by weight copper alloy. The PCD body was a right cylinder 13 mm in diameter and 8 mm long. The method as outlined in FIG. 5 column 2 was used whereby the precursor for the metallic component of the PCD body was reactively created in a water liquid suspension of starting diamond particles and was caused to nucleate and grow on the surfaces of the starting diamond particles. The following sequential steps and procedures were carried out in order to so manufacture this PCD free standing body.

a) 60 g of diamond powder with an average particle size close to 0.5 micro meters was suspended in 2.0 litres of de-ionised water. While continuously stirring the suspension, an aqueous mixed solution of copper nitrate and nickel nitrate was slowly added. Simultaneously an aqueous solution of sodium carbonate was slowly added. The mixed copper nitrate, nickel nitrate solution was made by adding 26 g of anhydrous copper nitrate, $Cu(NO_3)_2$, and 40 g of nickel nitrate hexahydrate, $Ni(NO_3)_2.6H_2O$, to 200 ml of de-ionised water. The sodium carbonate solution was made by adding 35 g of pure anhydrous sodium carbonate, $Na_2CO_3$, to 200 ml of de-ionised water. A mixed copper, nickel basic carbonate was precipitated and decorated the diamond particle surfaces. The 0.5 micro meter powder so decorated with the mixed alkaline carbonate precursor was then removed from suspension using a laboratory centrifuge. The material was washed free of the soluble sodium carbonate by-product by a few cycles of re-suspension in cold de-ionised water and removal from suspension by centrifuge. The material was dried under vacuum. The dried powder was then placed in an alumina ceramic boat with a loose powder depth of about 3 mm and heated in a flowing stream of argon gas containing 5% hydrogen. The top temperature of the furnace was 1000° C. which was maintained for 1 hour before cooling to room temperature. This furnace treatment dissociated and reduced the mixed copper, nickel basic carbonate precursor to form pure 50% copper, 50% nickel alloy particles decorating the surfaces of the diamond particles.

b) The general procedures used in Example 1 to produce consolidated and encapsulated right cylinder green bodies were then carried out.

c) The general procedures used in Example 1 to subject the green bodies to a pressure of 7.5 GPa at a temperature of 1950° C. for 1 hour were then carried out.

d) SEM image analysis was carried out on polished sections of the resulting PCD bodies and showed a well sintered continuous network of diamond, with an interpenetrating network comprising a single phase copper nickel alloy.

Example 8

Figure 14:
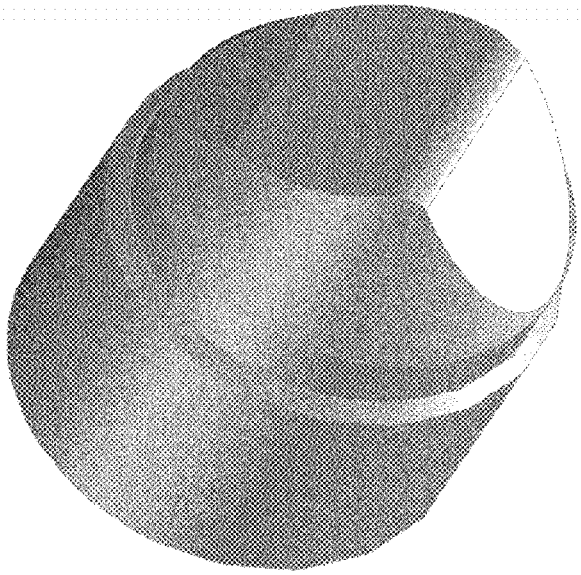
FIG. 14 is an embodiment of a 3-dimensional shaped PCD body intended for use in general applications.

The PCD material made in Example 2 based upon a multimodal particle size of diamond starting powder and with 9 volume percent cobalt was chosen and free standing PCD bodies of the 3-dimensional shape given in FIG. 14 were produced. FIG. 14 shows a 3-dimensional shaped PCD body intended for use in general applications. The body was of 45 mm of overall length. These PCD bodies are intended for use in general applications where rock removal is required, such as cutting elements in rotary rock drills or road planing heads. The bodies had a cylindrical barrel of diameter 25 mm diameter and 25 mm long. The cutting end was designed to have a sloping rounded chisel shape. The bodies were of 45 mm of overall length.

a) A quantity of diamond particulate mass decorated with cobalt was made using the procedures and material quantities using the method of FIG. 5 column 2 as described in Example 2, paragraph (a) above.

b) 65 g fractions of the diamond-metal powder mass were then filled into niobium pre-formed canisters which had been placed in compaction tooling of the desired geometrical shape. The diamond, metal powder charge was then compacted using a cylindrical piston. A second niobium cylindrical canister was then inserted into the tooling so that its outer surface slid inside the inner cylindrical wall of the first canister. This pre-compacted green body was then removed from the compaction tooling and a tungsten carbide hard metal mandrel inserted into the open end of the second niobium canister. The free air in the porosities of the pre-compacts was then evacuated and the canisters sealed under vacuum using an electron beam welding system known in the art. The canister assemblies were then subjected to cold isostatic compaction at a pressure of 200 MPa to consolidate to a high green density and to eliminate spatial density variations, and thereafter the mandrels removed. In this way encapsulated, homogeneous green bodies were produced with measured densities of about 2.6 $g \cdot cm^{-3}$, which correspond to a porosity of approximately 35% by volume.

c) The encapsulated green bodies were then inserted into pre-compacted semi-sintered high porosity ceramic components mirroring their shape. This sub-assembly was in turn inserted into a cylindrical cavity pre-formed in sodium chloride components so that the low shear strength sodium chloride completely surrounded the green body containing sub-assembly. The green bodies were then subjected to high pressure high temperature cycles as well known in the art of PCD manufacture at appropriate conditions to cause sintering of the diamond particles and the formation of the PCD free standing bodies. Typical conditions were about 5.7 GPa and about 1400° C. maintained for 25 minutes. The release of pressure and return to room temperature was carried out as outlined in Example 1 paragraph (c) above.

d) A sample of the sintered free standing PCD bodies was sectioned and polished and examined using SEM. From comparisons of images taken from various parts of the sections, it was observed that well-sintered homogeneous PCD material had been formed. The 3-dimensional geometry as pre-selected and indicated in FIG. 14 had been maintained with no significant distortion. By comparing the dimensions of the green bodies and the final sintered bodies, the dimensional shrinkage was found to be 12%. Thus, near-net size and shape behaviour was attained during the manufacture.

Example 9

PCD free standing, macro residual stress free, bodies each comprising an intergrown diamond network with a mean grain size of close to 10 micro meters with an interpenetrating metallic network made up of cobalt at 9 volume % were manufactured. The PCD bodies were chosen to be large discs with the desired diameter of 100 mm and thickness of 3 mm.

a) A diamond particulate mass decorated in 9 volume % cobalt particles was produced using the method of FIG. 5 column 2 and the procedures, chemical protocol and precursor as specified in Example 2.

b) 95 g fractions of this mass were then formed into disc green bodies of 106 mm diameter and 4 mm thick. Each green body was pre-compacted into niobium canisters using simple floating piston and cylinder tooling. The green bodies were vacuum degassed and the canisters sealed using electron beam welding. The dimensions of the green body were measured correcting for the known wall thicknesses of the canisters and the green body density was calculated to be 2.7 $g \cdot cm^{-3}$, which corresponds to approximately 33% porosity by volume.

c) Each green body was subjected to a pressure, temperature and time cycle in a large volume belt type high pressure apparatus known in the art. The specific conditions employed were typically 5.6 GPa and 1400° C. maintained for 35 minutes. The precautionary measured aimed at mitigating distortions as outlined in Example 1 were employed.

d) The resultant free standing green bodies suffered a minimal axially symmetric distortion whereby the thickness at the centre was about 1% greater than the chosen 3 mm and the thickness at the periphery of the disc was about 1% less than the chosen 3 mm. The homogeneity of the diamond-metal particulate mass and the green body density allows the shrinkage during sintering to be near uniform. The slight distortion experienced in the PCD discs results from unavoidable material flow characteristics and is typical of the high pressure apparatus employed. The distortion is within the range whereby compensating dimensions of the green body can be used. This may be done by appropriate slight changes of mass of the diamond charge and the shape of the compaction tooling. By a series of empirical trials near-net size and shape large discs of free standing PCD material can be achieved. After minimal final shaping and polishing free standing PCD discs 100.5 mm diameter and 2.95 mm thick were obtained with a final density of 3.9 $g \cdot cm^{-3}$.

Image analysis using SEM procedures confirmed the homogeneity of the PCD material above a scale of about 100 micro meters.

In summary, there is disclosed in this disclosure a polycrystalline diamond (PCD) construction or body which is free standing in that it is not attached or bonded, in any manner during any stage of the manufacture of the PCD, to a second body or substrate of a dissimilar material. In particular, a substrate such as tungsten carbide/cobalt hard metal commonly used in conventional PCD constructions where the cobalt binder metal is infiltrated into a mass of diamond powder to facilitate diamond particle-to-particle sintering is excluded.

Manufacturing methods whereby the metals required to enable sintering of the diamond particles are homogeneously combined with a pre-selected diamond powder of chosen specific size distribution are also described. These may allow both the amount and specific metallurgy of the metals to be independently pre-selected and chosen such that they are independent of the chosen diamond size and size distribution. Thus, key manufacturing degrees of freedom such as the diamond grain size distribution, the metal content of the PCD material and the atomic and alloy composition of the metal may be chosen and pre-selected independent of one another.

The PCD body so formed may comprises a single volume of PCD material which is homogeneous at a macroscopic scale, i.e., above a scale defined for this invention to be greater than ten times the average diamond grain size, with the coarsest component of grain size being three times the average grain size. The homogeneity at this scale provides for the PCD body to be considered as a spatially invariant material. At this macroscopic scale the PCD body is therefore stress free, having an absence of residual stress. Another consequence of not directionally infiltrating from a substrate is that the PCD body or construction is dimensionally unrestricted in this regard in any or all orthogonal directions. The dimensions in any particular direction are restricted only by the size of the high pressure apparatus used to manufacture the PCD body. With the high pressure apparatus known in the art the dimensions in any or all of the orthogonal directions may be up to 100 mm or more. The PCD body or construction can thus be viewed as a true 3-dimensional body of any shape and is not restricted to a layer or plate where one dimension is always of the order of a few millimeters, as is the case for conventional PCD bodies or constructs.

Methods are described where diamond particles are combined with the metals, alloys or metal/metal carbide combinations for PCD materials such that the metallic particles, grains or entities are smaller than the diamond particles. This may ensure the homogeneity of metal diamond distribution at a scale greater than the diamond particle or subsequent grain size maximum. The metals, alloys or metal/metal carbide in the mass are the sole source of the molten metal necessary and required to cause the sintering of the diamond particles via partial diamond re-crystallization mechanisms.

One method to create particulate diamond-metal masses, involves, as shown in FIG. 5 column 1, the crystallization of the precursor compound or compounds for the desired metallic particles from solution where the diamond powder particles are present in suspension in the solution. The precursor compound may be formed using any of the crystallization procedures known in the art, such as using reduction of temperature and or removal of solvent by evaporation. After total removal of the solvent, liquid suspension media, a well-mixed intimate combination of the diamond powder and precursor compound or compounds for the metal particles is produced. This method uses precursor compounds which are soluble in the liquid suspension media. Examples of liquid media or solvents are water and alcohol. Examples of possible precursor compounds are ionic salts, particularly the nitrates of the transition metals. In turn, the precursor compounds are dissociated and reduced to form the metallic particles by a heat treatment preferably in a reducing furnace environment.

Another method, as shown in FIG. 5 column 2, concerns the chemical reactive generation of the desired precursors for the desired metallic particles in liquid media with the presence of the diamond powders in suspension. Such precursors are significantly insoluble in the suspension media. The precursor compounds may nucleate and grow on the diamond particle surfaces to form a particulate decoration of the diamond surfaces with particles or grains of the precursor compounds. To facilitate the nucleation of the precursor materials on the diamond surfaces, the surface chemistry of the diamond particles may be pre-selected and/or deliberately altered to be hydrophilic and dominated by oxygen species prior to the suspension decoration with the precursor compounds.

In turn, the precursor compounds are dissociated and reduced by a heat treatment, for example in a reducing furnace environment, to form metallic particles which decorate the diamond particle surfaces and do not form a continuous metallic coat. The furnace environment may be a vacuum or involve flowing gas mixtures containing at least one gas capable of reducing the precursors or its dissociative products to the metallic state and/or metal carbide. Typical reductive gases are hydrogen and carbon monoxide. The heat treatment conditions may be pre-selected to be sufficiently high in temperature and of a sufficiently long duration to cause controlled amounts of amorphous non-diamond carbon to be formed on the metal and diamond surfaces. Alternatively, the heat treatment conditions may be pre-selected to be sufficiently low in temperature and short in time for non-diamond carbon not to form at a detectable level. For example when cobalt is used as the PCD metal component, temperatures above 800° C. for times of an hour or more are typical of the former case. The presence or absence of amorphous non-diamond carbon together with the control of its amount in the diamond/metal particulate mass is a degree of freedom which may play a role in the sintering mechanisms of the diamond particles.

The metallic particles now decorate the diamond particle surfaces. This approach may assist in ensuring that the metallic particles are always smaller than the diamond particles. Examples of liquid media may include water and alcohols. Some precursors may be insoluble salts of the transition metals such as carbonates, oxalates, acetates, tungstates, tantalates, titanates, molybdates, niobates, and the like. The reactants to reactively form these precursors are soluble salts in the chosen solvent or suspension medium. A reactant source of transition metals such as iron, nickel, cobalt, manganese, chromium, copper and the like may be nitrate salts. Alternatively, precursor compounds for transition metals which form stable carbides such as tungsten, molybdenum, tantalum, titanium, niobium, zirconium and the like may be oxides generated by the reaction of alkoxide compounds with water in alcohol suspension media. A reaction to generate tungstic oxide, $WO_3$ as a precursor to form tungsten carbide on diamond particle surfaces may be the reaction of ammonium paratungstate with dilute mineral acids such as nitric acid in water as solvent and suspension medium for the diamond.

Any of these chemical reactions to form the precursor compound decorants on the diamond particle surfaces may be done in sequence and applied to the pre-selected diamond powder as a whole or to any component of the diamond powder in appropriate suspension media. The diamond powder components may be based upon mass fractions or upon size, size distribution or any desired combination of these. Some of the diamond powder components may be left undecorated.

The above described methods of preparing the diamond grains and precursors assist in achieving high homogeneity in the sintered products.

Diamond powder fractions or components may also differ in diamond type, based upon the lattice defect composition and structure of the diamond crystals. A convenient way of such differentiation of diamond type between the diamond powder fractions or components can be to use diamond of natural origin as opposed to standard synthetic diamond origin. The lattice defects in natural diamonds are typically and predominantly made up of aggregated nitrogen impurity atomic structures. In contrast, the lattice defects in typical synthetic diamonds commercially crystallized using molten transition metal solvents are overwhelmingly dominated by single nitrogen atoms which substitute for individual carbon atoms. Moreover, the overall nitrogen content in natural diamond is typically an order of magnitude greater than for such synthetic diamond. PCD materials made with these different types of diamond exhibit significantly different properties. Pre-selected combinations of natural and synthetic diamonds may also be used for purpose.

In turn, the precursor compounds are dissociated and reduced to form metallic particles by a heat treatment, for example in a reducing furnace environment. In this way, different components of the diamond powder may be decorated in any of the different metallic particles and to any different degree. Thus the metallic particles may be pre-selected both in elemental composition and amount to be associated and decorated onto any chosen sub-component of the diamond particles. A vast number of PCD free standing body embodiments with desired compositions, structures and properties may, in this way, be generated using such prepared decorated diamond powder, metal combinations or masses.

The methods involving liquid suspension procedures may have particular utility in that they may be easily altered in scale and may allow production quantities of kilograms or more of accurate, homogeneous combinations of the diamond and metals and metals/metal carbides to be made. Moreover a notable and valuable characteristic of one method is that wide ranging combinations of diamond particles and metals, which may be pre-selected to vary independently in diamond particle size, metal amount and metal elemental composition, may be made.

The masses of diamond particle, metal combinations generated by the above methods are consolidated into cohesive so called "green bodies" of a pre-selected size and 3-dimensional shape. Consolidation may be effected in compaction die arrangements or isostatic compaction apparatuses as known in the art. Preferably hot isostatic compaction may be employed. Isostatic compaction techniques may have the benefit of spatial homogeneity of density in the green body, which assists in ensuring that the homogeneity of the starting diamond powder, metal combination is maintained and in turn engenders directionally equal shrinkage during subsequent sintering of the diamond particles. Free standing PCD bodies of near net pre-determined shape may then be made. The degree of shrinkage on sintering to form the PCD body may be measured for each specific diamond and metal composition. Such knowledge allows the size of resultant PCD body to be preselected for each PCD composition. Free standing PCD bodies of near net pre-determined size may then be made.

Temporary organic binders may be employed to provide cohesion in the green bodies. A special case of this and as an alternative to isostatic compaction, gel casting techniques may be employed as known in the art. This technique to form the green bodies also maintains spatial homogeneity of the diamond and metal distributions so that directionally equal shrinkage on sintering may occur, so that the 3-dimensional shape of the green body may be maintained on formation of the free standing body. There is a large number of powder, slurry and suspension based consolidation and green body formation techniques known in the art for material fabrication from particulate starting materials. In addition to those already disclosed above, these include injection moulding, slip casting, electrophoresis enhanced sedimentation, centrifugal enhanced sedimentation, 3-dimensional printing and many others. Each of the consolidation and green body making techniques has it own character in regard to the size of particles it may viably be applied to and also the degree to which homogeneity including that of porosity can be maintained. Preferences of techniques to be applied to make any given 3-dimensional and material embodiments take such character of the technique into consideration. In particular, the ability of a technique to be accurate, reproducible and maintain spatial homogeneity all in regard to porosity is of importance in the choice of preferred techniques to be used for any particular embodiment. This consideration is directed at the achievement of near net size and shape.

The green bodies generated by the above methods are subjected to high pressure, high temperature conditions for appropriate times to cause sintering of the diamond particles and form the free standing PCD bodies. Typical pressure and temperature conditions are in the range of 5 to 15 GPa and in the range of 1200 to 2500° C. respectively. Preferably pressures in the range 5.5 to 8.0 GPa along with temperatures in the range 1350 to 2200° C. may be used.

There is also disclosed a means of managing and controlling the micro residual stress magnitude of the free standing macro residual stress free PCD body, i.e., below a scale defined to be less than ten times the average grain size, where the coarsest component of grain size is no greater than three times the average grain size. Above this scale some embodiments provide for the PCD free standing body to be residual stress free, i.e., macro residual stress free. The methods disclosed may allow a very wide range of diamond to metal ratios and accurate metal compositions to be pre-selected independently of resultant diamond grain size and size distribution. Thus the relative differences in thermo-elastic properties between the diamond network and that of the metallic network can be pre-selected and accurately controlled.

Often, but not exclusively, the dominant properties in this regard are the thermal expansion coefficients of the metals in comparison to that of diamond. In such cases, on return to ambient conditions of temperature and pressure during the manufacturing process the relative differences of properties cause the diamond network to be generally compressed and the metallic network generally put into a state of tension. For each PCD body material pre-selected in regard to diamond and overall metal content, the micro residual stress magnitudes may thus be considered to be high, medium or low in magnitude by the use of metal compositions with thermal expansion coefficients in the ranges of 10 to 14, 5 to 10 and less than 5 ppm ° $K^{-1}$, respectively.

Some embodiments include the high carbon versions of controlled expansion transition metal alloys. A notable low expansion alloy with a very low minimum of linear coefficient of thermal expansion is an iron, 33 weight % nickel, 0.6 weight % carbon alloy (ref. 4). This alloy has a literature linear coefficient of thermal expansion value of 3.3 ppm ° $K^{-1}$, which falls into the less than 5 ppm ° $K^{-1}$ category. This alloy would then be expected to provide a metallic network in PCD materials where the tensile residual stress magnitude in the metallic network is low. However, this alloy has an elastic modulus of approximately 200 GPa, which is very different and removed from the elastic modulus of the diamond network, typically 1050 GPa. In such a case, the elastic property difference should dominate when the manufacturing conditions are returned to room conditions. The differential expansion of the diamond and metallic networks on release of pressure should then result in the metallic network experiencing a compressive micro residual stress. Thus, where metals of low thermal expansion coefficients are used it is possible that the residual stress in the metallic network can become compressive.

Any or all of the above aspects may provide for the manufacture of free standing PCD bodies, not attached to a dissimilar material, comprising a pre-selected combination of intergrown diamond grains of specific size and size distribution, in conjunction with an independently pre-selected specific metallic inter-penetrating network, with an independently pre-selected specific overall metal to diamond ratio. These primary degrees of freedom may be independently pre-selected.

Some embodiments may benefit from removal of the metal from a chosen depth from the surface of the PCD body or throughout the volume of the PCD body. This may be done using, for example, chemical leaching techniques well known in the art.

In summary, methods of forming embodiments involve, for example, diamond particle suspension in a liquid and the crystallisation and/or precipitation of precursor compound for the required metals of the PCD material to be formed and the subsequent thermal decomposition/reduction of these precursors to form the metals. These methods are inherently characterised by the resultant metallic particles being smaller than the chosen diamond particles. The described methods involving diamond particle suspensions and the crystallisation and/or precipitation of precursor compounds for the metals become more and more practicable and efficient as the diamond particle sizes become smaller and smaller down to and including sub-micron sizes. This is due to the precursor compounds for the metals being influenced in their crystallisation and/or precipitation by the overall diamond surface area, which becomes progressively larger as the diamond particles become smaller. In addition, dissociation/reduction of precursor compounds for metals readily form very fine and often nano-sized metal particles. The methods described herein for forming embodiments of free standing bodies of PCD material thus provide good practicality for PCD materials with desired very fine diamond grain sizes, particularly for diamond grain sizes in the sub-micron range.

This character of these suspension methods, along with the suspension stirring dynamics, provides for a high degree of homogeneity of mix of the diamond particles and metallic particles, and may even approach the ultimate homogeneity in this regard. This homogeneity of diamond and metal in a particulate mass assists in the formation of a green body and subsequent free standing PCD body formed at high pressure high temperature which is homogeneous with respect to its diamond and metallic composition above a scale related to the average and maximum grain size of the diamond grain size of the diamond network and also which spans the dimensions of the free standing PCD body. This scale can be used to define the so-called "macroscopic" scale of the PCD material. It has been experientially determined by the inventors that using the methods described herein the diamond network to metallic network volume ratio is spatially constant and invariant above a scale greater than ten times the average diamond grain size, provided that the largest component of diamond grain size is no greater than three times the average diamond grain size. This spatial invariance of diamond network to metallic network volume ratio at the defined macroscopic scale, across the dimensional span of the PCD body means that, at completion of the manufacturing process, the free standing PCD body will be macroscopically residual stress free.

Conversely, if the PCD body is inhomogeneous, with the diamond network to metallic network volume ratio varying from place to place in the PCD body, the PCD material from place to place will differ in thermal expansion and elastic properties. These spatial differences in properties then necessarily lead to a significant macroscopic residual stress field across the dimensional span of the PCD body, caused by the spatial differential in contraction, when the PCD body is returned to room temperature and pressure at the end of the high temperature high pressure process.

Free standing PCD bodies of embodiments which are residual stress free may have considerable benefits in applications involving mechanical action such as general machining, drilling and the like. In such applications, the tooling material efficiency is often governed by crack related processes leading to undesired fracture behaviour such as chipping and spalling. It is well known in the art that macroscopic, tool piece dimension spanning, residual stress fields can easily enhance the propagation of cracks and thereby increase the occurrence of chipping and spalling. The absence of macroscopic residual stress fields mitigates such behaviour and such absence is therefore desirable.

REFERENCES

1. D. Dollimore, "The thermal decomposition of oxalates. A review", Thermochimica Acta, 117 (1987), 331-363.
2. C. Ehrhardt, M. Gjikaj, W. Brockner, "Thermal decomposition of cobalt nitrate compounds: Preparation of anhydrous cobalt (II) nitrate and its characterization by Infrared and Raman spectra", Thermochimica Acta, 432 (2005), 36-40.
3. W. Brockner, C. Ehrhart, M. Gjikaj, "Thermal decomposition of nickel nitrate hexahydrate, $Ni(NO_3)_2.4H2O$", Thermochimica Acta, 456 (2007), 64-68.
4. E. L. Frantz, "Low-Expansion Alloys", Metals Handbook, $10^{th}$ ed, vol. 2, 889-896.
5. Chien-Min Sung, "A Century of Progress in the Development of Very High Pressure Apparatus for Scientific Research and Diamond Synthesis", High Temperatures-High Pressures, Vol. 29, p 253-293. (1997).

The invention claimed is:

1. A free standing PCD body comprising a PCD material formed of combination of intergrown diamond grains forming a diamond network and an interpenetrating metallic network, the PCD body not being attached to a second body or substrate formed of a different material during any stage of its manufacture, wherein:

a) the diamond network is formed of diamond grains having a plurality of grain sizes, the diamond network comprising a grain size distribution having an average diamond grain size, wherein the largest component of the diamond grain size distribution is no greater than three times the average diamond grain size; and b) the PCD material forming the free standing PCD body is homogeneous, the PCD body being spatially constant and invariant with respect to diamond network to metallic network volume ratio, wherein the homogeneity is measured at a scale greater than ten times the average grain size and spans the dimension of the PCD body, the PCD material being macroscopically residual stress free at said scale.

2. The free standing PCD body of claim 1, wherein the metallic network comprises a carbon containing alloy with metal(s) facilitating partial recrystallisation of diamond to form diamond particle bonding of the diamond network from molten metal solution, wherein a dispersion of reaction product compounds, formed with said metal or metals and any other reactive metal, element or compound, is absent in the body of PCD material.

3. The free standing PCD body of claim 1, wherein the metallic network comprises a carbon containing alloy with metal(s) facilitating partial recrystallisation of diamond to form the diamond particle bonding of the diamond network from molten metal solution with a dispersion of one or more metal carbide reaction products created by reacting one or more of the metals tungsten, molybdenum, titanium, tantalum, niobium, zirconium, vanadium and chromium with a portion of the starting diamond powder prior to high pressure high temperature partial re-crystallisation of the diamond particles to form the diamond network.

4. The free standing PCD body of claim 1, wherein the average diamond grain size is in the range 0.1 to 1.0 micro meters, the volume content of the metallic network being in the range 2 to 12 volume percent and having been chosen independently of the starting diamond particle size distribution and thus independently of the diamond grain size distribution in the resultant PCD free standing body.

5. The free standing PCD body of claim 1, wherein the average diamond grain size is in the range 1.0 to 10.0 micro meters, the volume content of the metallic network being in the range 2 to 10 volume percent and having been chosen independently of the starting diamond particle size distribution and thus independently of the diamond grain size distribution in the resultant PCD free standing body.

6. The free standing PCD body of claim 1 wherein the average diamond grain size is in the range 10.0 to 20.0 micro meters, the volume content of the metallic network being in the range 2 to 8 volume percent and having been chosen independently of the starting diamond particle size distribution and thus independently of the diamond grain size distribution in the resultant PCD free standing body.

7. The free standing PCD body of claim 1, wherein the volume content of the metallic network is lower than a value y volume percent, where $y=-0.25x+10$, x being the average grain size of the PCD material in micro meter units, the volume content of the metallic network having been chosen independently of the starting diamond particle size distribution and thus independently of the diamond grain size distribution in the resultant PCD free standing body.

8. The free standing PCD body of claim 1, wherein the largest dimension of the PCD body in any chosen direction within the PCD body is in the range 5 to 150 mm.

9. The free standing PCD body of claim 8, wherein the dimension of the PCD body in any orthogonal direction to the largest dimension is in the range 5 to 150 mm.

10. The free standing PCD body of claim 1, wherein the metallic network comprises a controlled expansion alloy containing carbon in solid solution with a linear coefficient of thermal expansion at room temperature lower than 13 ppm° $K^{-1}$, the composition of each alloy component being within +/−0.1 weight percent of a chosen value, such that the PCD material has a microscopic residual stress magnitude less than the micro residual stress magnitude when the metal is a cobalt carbon alloy at a scale less than ten times the average grain size, and wherein the largest component of grain size is no greater than three times the average grain size.

11. The free standing PCD body of claim 10, wherein the metallic network comprises a controlled expansion alloy made of iron, 33 weight percent nickel and up to 0.6 weight percent carbon with a linear coefficient of thermal expansion at room temperature of 5 ppm ° $K^{-1}$.

12. The free standing PCD body of claim 10, wherein the metallic network comprises a controlled expansion alloy with a linear coefficient of thermal expansion lower than 5 ppm ° $K^{-1}$ such that the microscopic residual stress in the metallic network has a general compressive nature.

13. The free standing PCD body of claim 1, wherein the metallic network is pre-selected to contain copper or to be a nickel-copper alloy.

14. The free standing PCD body of claim 1, wherein the metallic network is substantially tungsten-free.

15. The free standing PCD body of claim 1, wherein the diamond grain size distribution is pre-selected independently to the metal content and the metal alloy composition to be multimodal.

16. The free standing PCD body of claim 1, wherein at least a portion of the PCD body is substantially free of metal content in interstices between the diamond grains to a depth from an exterior surface of the PCD body.

17. The free standing PCD body of claim 1, wherein the diamond to metal mass ratio in the PCD body is in the ratio of 99.9 to 1, the PCD body being substantially free of metal content in interstices between the diamond grains.

18. The free standing PCD body of claim 3, wherein the metallic network comprises cobalt and a dispersion of tungsten carbide (WC) particles.

19. The free standing PCD body of claim 18, wherein the metallic network comprises 23 weight percent cobalt and 77 weight percent tungsten carbide (WC).

20. The free standing PCD body of claim 3, wherein the metallic network comprises:

cobalt with a dispersion of tantalum carbide (TaC) particles; or nickel and titanium carbide; or a controlled expansion alloy containing carbon in solid solution with a linear coefficient of thermal expansion at room temperature lower than 13 ppm° $K^{-1}$, the composition of each alloy component being within +/−0.1 weight percent of a chosen value, with a dispersion of one or more carbide reaction product created by reacting one or more of the metals tungsten, molybdenum, titanium, tantalum, niobium, zirconium, vanadium and chromium with a portion of the starting diamond powder prior to high pressure high temperature partial re-crystallisation of the diamond particles to form the diamond network, such that the PCD material has a microscopic residual stress magnitude less than the micro residual stress magnitude when the metal is a cobalt carbon allow at a scale less than ten times the average grain size where the largest component of grain size is no greater than three times the average grain size.

21. The free standing PCD body of claim 3, wherein there is an absence in the PCD body of dispersed particles derived from abrasive action on mill body milling and mixing apparatus exemplified by oxide ceramics particles such as alumina ($Al_2O_3$).

22. The free standing PCD body of claim 2, wherein the metal(s) facilitating partial recrystallization of diamond comprise(s) one or more of iron, nickel, cobalt and manganese.

23. The free standing PCD body of claim 2, wherein the amount of metal or alloy and the atomic composition of the metal or alloy making up the metallic network, is chosen independently of the starting diamond particle size distribution, and thus independently of the diamond grain size distribution in the resultant PCD free standing body.

* * * * *